US011732733B2

(12) United States Patent
Connal et al.

(10) Patent No.: US 11,732,733 B2
(45) Date of Patent: Aug. 22, 2023

(54) METHOD AND APPARATUS FOR CONVERSION OF A PNEUMATIC ACTUATOR TO AN ELECTRIC POWER PLATFORM

(71) Applicant: Hybrid Automation Inc., Derry, NH (US)

(72) Inventors: Robert Connal, Derry, NH (US); Scott Frash, Georgetown, MA (US)

( * ) Notice: Subject to any disclaimer, the term of this patent is extended or adjusted under 35 U.S.C. 154(b) by 0 days.

(21) Appl. No.: 17/590,881

(22) Filed: Feb. 2, 2022

(65) Prior Publication Data

US 2022/0154737 A1 May 19, 2022

Related U.S. Application Data

(63) Continuation-in-part of application No. 16/999,635, filed on Aug. 21, 2020, now Pat. No. 11,255,350.

(60) Provisional application No. 62/889,765, filed on Aug. 21, 2019.

(51) Int. Cl.

| | |
|---|---|
| ***F15B 9/03*** | (2006.01) |
| ***F15B 13/02*** | (2006.01) |
| ***F15B 21/041*** | (2019.01) |

(52) U.S. Cl.

CPC ..... *F15B 9/03* (2013.01); *F15B 13/025* (2013.01); *F15B 13/027* (2013.01); *F15B 21/041* (2013.01); *F15B 2211/20515* (2013.01); *F15B 2211/8752* (2013.01)

(58) Field of Classification Search

CPC .. F15B 1/022; F15B 11/06; F15B 2211/8752; F15B 20/002; F16K 31/1221

See application file for complete search history.

(56) References Cited

U.S. PATENT DOCUMENTS

| | | | | |
|---|---|---|---|---|
| 4,065,094 | A * | 12/1977 | Adams | F15B 15/18 60/404 |
| 4,294,284 | A * | 10/1981 | Herd | F16K 3/0254 251/327 |
| 4,585,207 | A * | 4/1986 | Shelton | F16K 31/1221 91/161 |
| 5,244,004 | A * | 9/1993 | Robertson | F15B 20/00 60/329 |
| 6,053,202 | A * | 4/2000 | Cunningham | E21B 34/10 91/461 |
| 6,892,534 | B2 * | 5/2005 | Silva | F15B 1/022 60/404 |
| 8,596,608 | B2 * | 12/2013 | Grimseth | E21B 33/0355 251/74 |
| 9,239,064 | B2 * | 1/2016 | Helbig | F15B 1/022 |
| 9,803,657 | B2 * | 10/2017 | Froehlich | F15B 20/002 |
| 10,041,513 | B2 * | 8/2018 | Böhner | F15B 15/1476 |

(Continued)

FOREIGN PATENT DOCUMENTS

| | | | |
|---|---|---|---|
| KR | 101452726 B1 * | 10/2014 | |
| KR | 20170057743 A * | 5/2017 | |

OTHER PUBLICATIONS

KR 101452726 B1 with translation (Year: 2022).*

*Primary Examiner* — Thomas E Lazo

(74) *Attorney, Agent, or Firm* — Duane C. Basch; Dawson Law Firm, PC

(57) ABSTRACT

An electric-powered fail-safe actuator for use with a valve, where the actuator stores potential energy for conversion to kinetic energy to close or open the valve to the fail-safe position.

21 Claims, 31 Drawing Sheets

(56) References Cited

U.S. PATENT DOCUMENTS

| | | | | |
|---|---|---|---|---|
| 2013/0186080 | A1* | 7/2013 | Hata | F15B 15/226<br>251/63.6 |
| 2016/0160840 | A1* | 6/2016 | Madsen | F15B 1/08<br>416/147 |
| 2016/0281746 | A1* | 9/2016 | Carez | F15B 11/064 |
| 2017/0268695 | A1* | 9/2017 | Turner | F16K 37/0083 |
| 2018/0371935 | A1* | 12/2018 | Oka | F01D 17/145 |
| 2019/0145542 | A1* | 5/2019 | Rehhoff | F16K 31/124<br>137/488 |

* cited by examiner

METHOD AND APPARATUS FOR CONVERSION OF A PNEUMATIC ACTUATOR TO AN ELECTRIC POWER PLATFORM

This application is a continuation-in-part of, and claims priority under 35 U.S.C. § 120 from, co-pending application Ser. No. 16/999,635 for a METHOD AND APPARATUS FOR CONVERSION OF SINGLE-ACTING PNEUMATIC ACTUATOR TO ELECTRIC POWER PLATFORM, filed Aug. 21, 2020 by Robert Connal et al., which claimed priority under 35 U.S.C. § 119(e) to U.S. Provisional Patent Application No. 62/889,765, entitled CONVERSION OF SINGLE-ACTING PNEUMATIC ACTUATOR TO ELECTRIC POWER PLATFORM, filed Aug. 21, 2019 by Robert Connal et al., both of which are hereby incorporated by reference in their entirety.

BACKGROUND AND SUMMARY

The disclosed electric power actuators pertain generally to fluid flow control and, more particularly, to a pneumatic control system designed to operate and control various types of pneumatic actuators.

As evidenced by the oil and gas industry, there is a need for better, more reliable, and fail-safe electric actuators. Most electric actuators are dumb; meaning that in the event of power loss the actuator/valve fails in place, be it open, closed or somewhere between. In hazardous locations deemed "electrically classified" (e.g., Class I Division I or similar), fail-safe electric actuators are frequently required to prevent liquid or gas flow downstream from the valve operated by the actuator.

Electric fail-safe actuators may be defined as providing the following operating characteristics: upon loss of electrical power to the electric actuator, the actuator has stored potential energy that is converted to kinetic energy to close or open the valve to the fail-safe position. Potential energy stored within an electric actuator is typically in the form of either a battery, capacitor, torsion spring or compressed spring. Currently, fail-safe electric actuator technology suffers from a wide range of issues, including but is not limited to, torque output, lack of system reliability, very large/heavy unit size for a given valve, limited cycling before requiring maintenance, etc.

The disclosed improvements in the nature of a fail-safe electric power actuator connect directly to the intake and exhaust air ports of a pneumatic actuator and require an external voltage source, like all electric actuators. The valve automation industry has embraced pneumatic actuator valve control for decades based on its simplicity of design, reliability and inherent fail-safe design. The disclosed embodiments convert a pneumatic actuator to an electric actuator. The disclosed electro-pneumatic device utilizes any third party, quarter-turn pneumatic actuator as the base operating platform, but can easily be adapted to other platforms and to accommodate torque outputs far exceeding existing electric fail-safe technologies.

Pneumatic actuator systems typically involve a source of compressed air that is routed through a network of pipes. The compressed air is typically sourced from a compressor driven by an electric motor or an internal combustion engine. The compressed air is routed to and from cylinder chambers contained within various types of pneumatic actuators in order to move a piston contained within the cylinders. The piston may have a shaft extending out of the cylinder and connected to the component to be moved, such as a ball or butterfly valve in a fluid pipeline.

The pneumatic system moves the piston by forcing air (gas) into the first end of the cylinder while simultaneously withdrawing or exhausting air out of a second end of the cylinder. Conversely, the pneumatic system may also force air into the second end of the cylinder while simultaneously exhausting air out of the first end of the cylinder in order to retract the piston in the opposite direction. By driving the air into alternate ends of the cylinder, the piston is moved such that the shaft can be displaced in any position for doing useful work. The compressed air may pass through a filter to clean the air and prevent damage to components.

Pneumatic systems are commonly used in large scale applications such as in power plants and refineries for controlling system components such as a working valve. In such applications, proper maintenance is required to ensure that the components have a long and reliable working life. If maintenance is not kept up with, such as the changing of air filters, which filter the air entering the system, this lack of maintenance can ripple through the system damaging components downstream.

Pneumatic systems that are routed through a network of pipes in large scale applications such as in power plants and refineries commonly fall victim to problems such as line leakage or downstream pressure loss. In many of these applications, there are several hundred pipes and fittings routed throughout a location causing the maintenance and isolation of faulty pipes and fittings to be difficult. Statistics from the US Department of Energy show the average manufacturing plant loses 20-30% of its compressed air due to leaks (source: https://www.energy.gov/sites/prod/files/2014/05/f16/compressed_air3.pdf#targetText=Leaks%20are%20a%20significant%20source,30%25%20of%20the%20compressor's%20output.&targetText=Fluctuating%20system%20pressure%2C%20which %20can,less%20efficiently%2C%20possibly%20affecting%20production). Any leakage of generated compressed air is a direct cost to the entity utilizing such pneumatic systems.

Pneumatic systems routed through a network of pipes in large scale applications often suffer from the additional problems of responsiveness and repeatability due to their placement at large distances from their fluid (e.g., gas) supply source. This lack of responsiveness and repeatability can cause unpredictable behavior in large pneumatic systems ranging from timing of valve transitions to lack of pressure at key placement points.

The current mainstream alternative to pneumatic actuator systems are electric motor, gear driven actuators. These electric actuators are known for their ability to operate at high levels of power efficiency, low levels of power density, and high levels of accurate repeatability and control. Pneumatic systems are generally known for the opposite; low levels of power efficiency, high levels of power density, and low levels of accurate repeatability and control.

The electric power actuators disclosed herein specifically address and alleviate the above referenced deficiencies associated with existing pneumatic and electric control systems. More specifically, the electric power actuator includes an independent pneumatic control system for generating the work necessary to move the piston within a pneumatic actuator. As will be described below, the pneumatic control system of the disclosed electric power actuators differs from pneumatic control systems of the prior art in that it may utilize a closed loop air transfer system design for increasing both the efficiency of the pneumatic system while also reducing the required maintenance and simplifying the integration of providing compressed fluid to pneumatic systems.

The pneumatic control system is configured for providing the compressed fluid necessary for the positioning of a piston within a pneumatic actuator. The closed loop air transfer system configuration provides a means of eliminating the need for an air filter at the inlet of the compressor that provides compressed air to the system. The closed loop air transfer system configuration for several of the disclosed embodiments also allows for the use of other working fluids such as nitrogen or helium gas, which would not be possible in an open loop configuration that vents and draws in working fluid from ambient surroundings. Another advantage to the closed loop air transfer system configuration is the elimination of potential leaks, which cause significant problems in the efficiency of pneumatic systems. In the unlikely event of an air leak, the system includes a built-in recharge function to maintain optimal performance, and thereby further increasing overall reliability.

The disclosed electric power actuators allow for simplified integration of pneumatic systems into industry locations that utilize such valve control systems by inherently being a self-contained fluid supply to the pneumatic actuators commonly found in these locations. This provides the distinct advantage of isolating any problems which may occur as opposed to isolating the problems of a much larger and more complex system such as the network of pipes commonly used in these applications, as previously described. Another advantage of the single self-contained system is the elimination of the common problem of line pressure loss due to actuators being located at large distances from the pressurized fluid supply source, allowing for increased responsiveness and repeatability.

The closed pneumatic system configuration providing work to a single acting pneumatic actuator also creates an increase in system efficiency due to the ability of the actuator to act as a pressurized fluid supply source to the inlet of the compressor providing compressed fluid to the system. This feature both reduces the minimum time between valve transitions and reduces the power drawn from the compressor—due to it having to overcome a smaller pressure differential during charge cycles.

Disclosed in embodiments herein is an electric-powered fail-safe actuator, including: an electrically-powered source of pressurized fluid; a directional control valve, responsive to a control signal and having at least an inlet port fluidly connected to the source of pressurized fluid, the control valve controlling the flow of pressurized fluid from the source to at least one output port of the control valve in response to the control signal; a pneumatic actuator, said actuator having a first port fluidly connected to the at least one output port of the control valve with a gas line, and a vent port, wherein a pressurized fluid applied to the first port causes the movement of a biased piston in said pneumatic actuator and produces movement of a stem attached to the piston; and a gas line fluidly connecting the vent port of the actuator and the source of pressurized fluid to complete a closed loop circuit; wherein the fail-safe actuator is suitable for mechanical connection between the stem and a valve.

Further disclosed in embodiments herein is a method for providing an electric-powered fail-safe actuator, comprising: providing a pneumatic accumulator suitable for storing a pressurized gas; providing a source of pressurized gas, and fluidly connecting a discharge port of the source of pressurized gas to the pneumatic accumulator; fluidly connecting a directional control valve, responsive to a control signal, in series with the pneumatic accumulator and a pneumatic actuator having a spring return, wherein the pneumatic actuator is suitable for mechanical connection to operate a valve; using the directional control valve to control the flow of pressurized gas stored in the pneumatic accumulator to the pneumatic actuator; triggering, in response to the control signal, a first state transition of the directional control valve to allow a flow of pressurized gas from said accumulator into a first port of the pneumatic actuator, thereby producing a change in position of a piston in the pneumatic actuator from a rest position to an actuated position; and triggering, in response to a change in the control signal, a second state transition of the directional control valve to stop the flow of pressurized gas from said accumulator into the first port of the of the pneumatic actuator, and thereby allowing the piston in the pneumatic actuator to return to the rest position under the force of the pneumatic actuator spring return.

Also disclosed herein is an electric-powered fail-safe actuator, comprising: a source of pressurized fluid; a control valve, fluidly connected to the source of pressurized fluid; a spring-return actuator, fluidly connected to the control valve, to receive the pressurized fluid via the control valve; and a fluid connection between a vent port of the actuator and the source of pressurized fluid.

Figure 1:
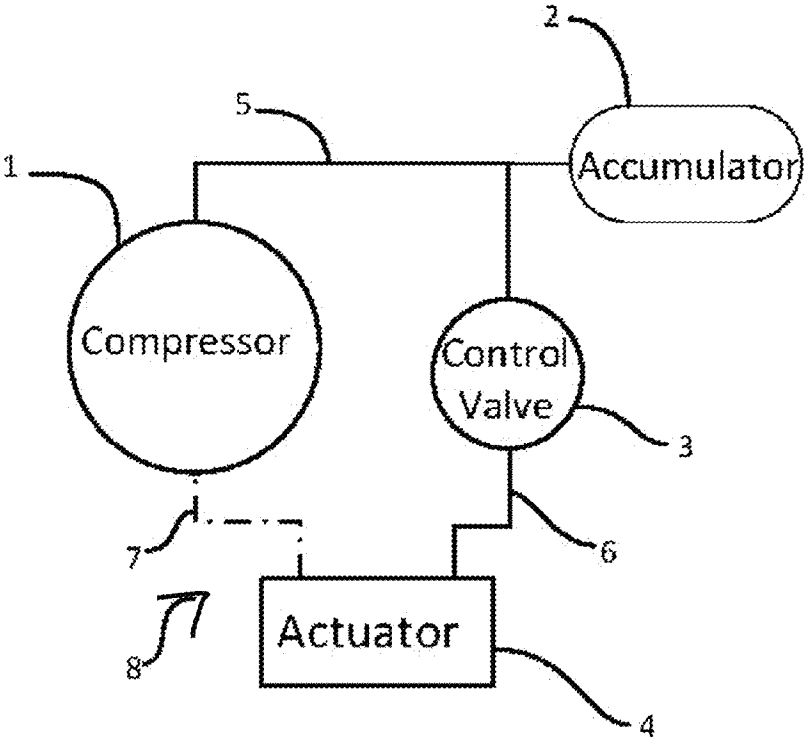
FIG. 1 is a schematic illustration of a pneumatic control system in accordance with an electric power actuator embodiment.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Referring to FIG. 1, depicted therein is one embodiment of the electric power actuator in its simplest form comprising a source of compressed gas (air) such as, for example compressor 1 and/or accumulator 2, connected to a control valve 3 by fluid line 5, and a fluid actuator 4 connected to control valve 3 by fluid line 6. Fluid line 7 is an optional fluid line that, when included, allows for closed system operation of the embodiment of the electric power actuator.

It should be understood that the various components in pneumatic circuits, such as those disclosed herein are generally interconnected by sealed fluid/gas lines, and such fluid/gas lines interface or connect to the components at ports existing in the components. The various connections, while possibly permanent connections, are likely threaded and compression-fit connections both between and to the components. Accordingly, when the disclosure indicates that components are connected, or more specifically fluidly connected, to one another, it is to be understood that there is at least one sealed fluid/gas line between ports of the connected components. It will be further appreciated that the lines and connections employed may be formed of various materials, including metals, alloys as well as high-strength or flexible plastics, depending upon the pressures to be employed in the pneumatic circuits.

Figure 2:
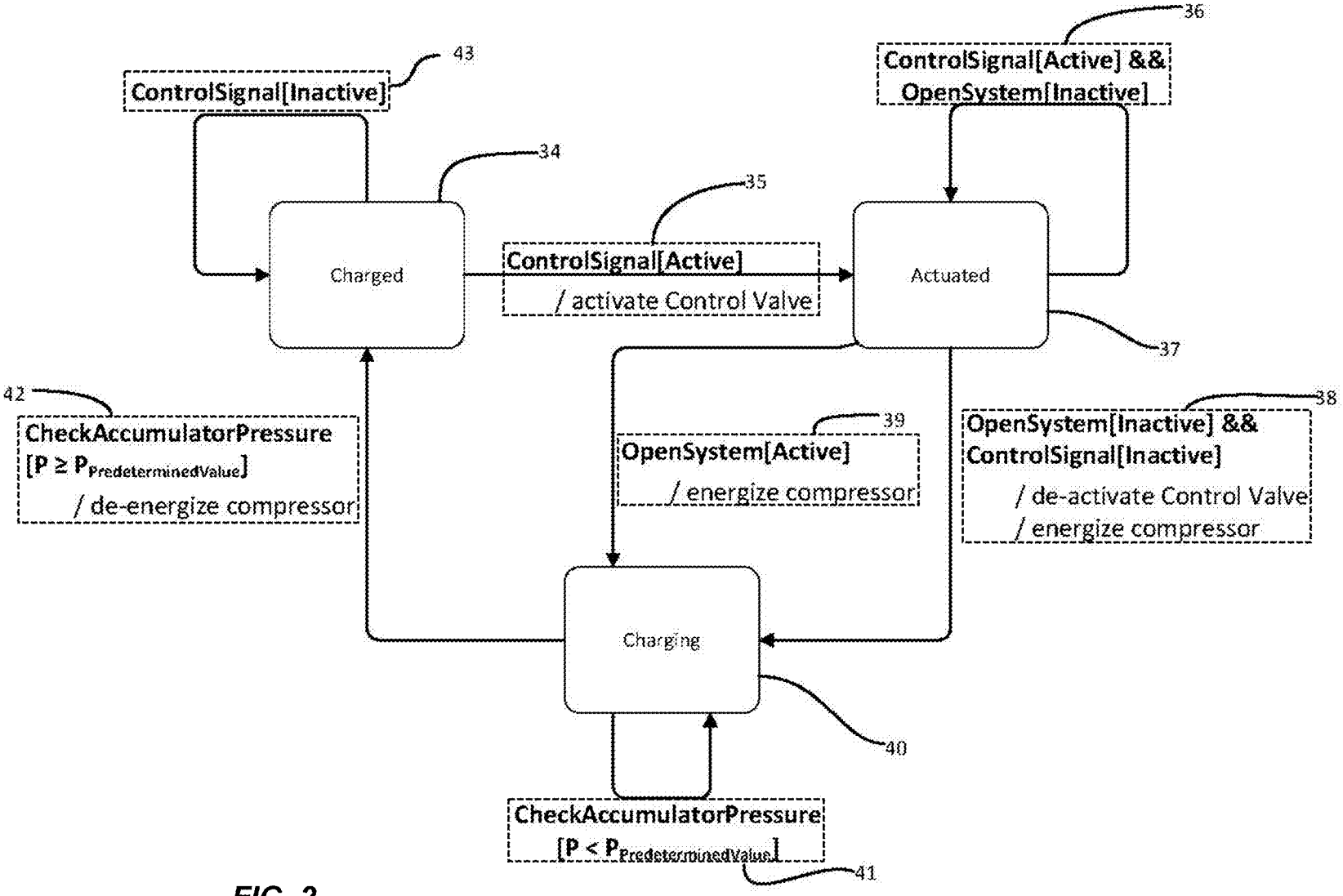
FIG. 2 is an illustrative state transition diagram representing the cycle of state transitions for the pneumatic control system of FIG. 1.
Figure 3:
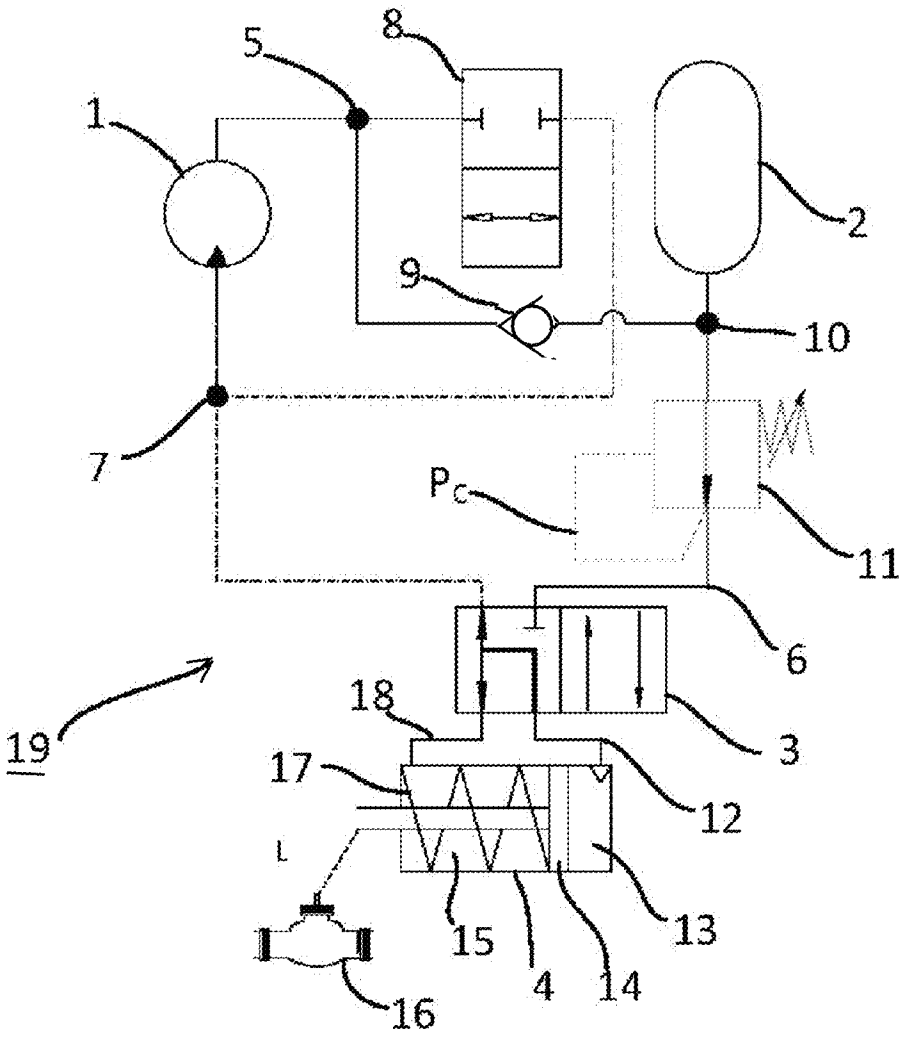
FIG. 3 is a schematic illustration of a pneumatic control system illustrating an embodiment of an electric power actuator.

The state transition diagram depicted in FIG. 2 represents the state transitions of a pneumatic control circuit 8 illustrated by the schematic drawing in FIG. 1. This pneumatic control circuit serves the purpose of providing compressed fluid to one or more chambers (e.g., 13, 15) of actuator 4 in order to operate the actuator to accomplish some task requiring mechanical movement, such as for example, a pneumatic actuator mechanically coupled to a fluid valve as depicted in FIG. 3. It will be appreciated that reference to a pneumatic actuator includes, but is not limited to, single-acting, double-acting, vane type, diaphragm type, scotch yoke, linear and similar actuator types.

The pneumatic control circuit (e.g., 19 in FIG. 3) is comprised of a fluid compressor 1 whose fluidic output is connected to a fluid line 5, which is connected to both a control valve 3 and an accumulator 2. A downstream port of control valve 3 is connected to a fluid line 6 that connects to a port of an actuator 4 on its terminating end. This connection allows for the fluidic output of compressor 1 to flow into a port of actuator 4 under the condition that control valve 3 is positioned in such a way that it does not block flow from fluid line 5 to fluid line 6. Optionally, and in some embodiments, another port of actuator 4 may be connected to a fluid line 7 whose terminating end is connected to an inlet of compressor 1. This optional connection allows for compressor 1 to recycle exhausted fluid contained within a chamber of actuator 4 and creates a closed pneumatic system eliminating the need for filtering ambient air at the inlet of compressor 1 as is common in pneumatic control circuits that operate pneumatic actuators.

The state transition diagram depicted in FIG. 2 represents the various states that control circuits 8, 19 can take while in operation. Referring to FIG. 2, charged state 34 represents the state in which accumulator 2 is pressurized with some working fluid (gas) to a pressure greater than or equal to a predetermined value ($P_{PredeterminedValue}$). This predetermined pressure value is selected to be large enough so that if control valve 3 becomes activated, defined by control valve 3 being in a position which allows fluid flow from accumulator 2 into a chamber of actuator 4, the flow of fluid into the chamber of actuator 4 will cause the fluid pressure in that chamber to rise to a pressure sufficient to operate the actuator. It should be noted that operating the actuator refers to actuator 4 undergoing mechanical motion due to the pressurization of at least one of its chambers. The system will remain in charged state 34 indefinitely as shown by event 43, until an active control signal is sent to control valve 3. The active control signal, which may be the result of an electrical signal from an external source, places the valve into its activated state as illustrated by event 35. After the occurrence of event 35, the system will enter into actuated state 37. Actuated state 37 represents the state of the system in which at least one chamber of actuator 4 is pressurized to a fluid pressure equal to or exceeding the necessary pressure to operate the actuator. While in actuated state 37, if the system is configured as an open system defined by the absence of fluid line 7, the system will begin charging as represented by event 39, otherwise, if the system is configured as a closed loop air transfer system, defined by the inclusion of fluid line 7 (e.g., between the actuator vent port and the compressor inlet port), the system will remain in the actuated state indefinitely as long as the control signal to control valve 3 remains active as illustrated by event 36.

While in charging state 40, compressor 1 will remain energized, providing compressed fluid to accumulator 2. Compressed fluid will continue to flow into accumulator 2 until the fluid pressure contained within it is equal to or exceeds the predetermined value ($P_{PredeterminedValue}$) previously described as represented by event 41. At this point a control circuit such as, for example, the control circuits depicted in FIGS. 4 and 5, will de-energize compressor 1, and force the system to return into charged state 34 as represented by event 42.

One embodiment of the disclosed electric power actuator is illustrated schematically in FIG. 3. Referring to FIG. 3, a pneumatic control circuit 19, is capable of operating a pneumatic actuator 4, such as, in this embodiment, a piston 14 reciprocally disposed in a cylinder contained in the assembly of actuator 4. In the embodiment shown, the piston 14, is single-acting with a spring 17 biasing the piston in a direction against the force applied by compressed fluid (air) introduced into chamber 13 of actuator 4. It will be appreciated that in an alternative embodiment of the electric power actuator, a double-acting piston cylinder arrangement may be used with compressed air being selectively introduced or exhausted from each chamber of the cylinder on each side of the piston, and in such an embodiment the compressed air would provide stored kinetic (potential) energy for fail-safe operation. Pneumatic actuator 4 may, for example, operate a valve 16 which is mechanically coupled to a pipeline (e.g., FIGS. 24-25).

Actuator 4 operates valve 16 by opening or closing the valve via a suitable mechanical link L (e.g., a bar, lever, cam or the like) when actuator 4 is provided with a supply of compressed fluid (gas), at a pressure level suitable for operation of actuator 4, directed into chamber 13 of actuator 4. Compressed gas for operating actuator 4 is delivered from a dedicated compressor 1 operatively connected to the actuator via pneumatic control circuit 19. While compressor 1 is energized and providing a supply of compressed gas to gas line 5, a control valve 8 is positioned as illustrated. This consequently directs the flow of compressed gas from compressor 1 into gas line 5 through check valve 9 and into gas line 10. Compressed gas on the downstream side of check valve 9 can either flow into an accumulator 2 or through a gas regulator 11. A control valve 3 is connected to the downstream port of regulator 11 via gas line 6. While compressor 1 is energized, control valve 3 is in the position illustrated, causing compressed gas from compressor 1 to begin building pressure in accumulator 2. Accumulator 2 acts, when adequately pressurized, as a gas supply for the operation of actuator 4. Regulator 11 is set to provide a downstream pressure of $P_c$, which is at least equal to the pressure required to be provided to the inlet of chamber 13 to operate actuator 4.

When the pressure in accumulator 2 reaches a value $P_A$, which is sufficient to provide a constant flow of gas into the inlet of chamber 13 of actuator 4, such that the pressure in gas line 12 does not fall below $P_c$, compressor 1 becomes de-energized and stops the flow of gas into gas line 5. At this moment, valve 8 will be moved to the open position (not illustrated) and allow for the pressure between the inlet and outlet of compressor 1 to equalize. A gas line 7 may be placed as illustrated by the dashed line to connect control valve 3 to the inlet of compressor 1, creating a closed pneumatic system as previously described. It will be appreciated that in another alternative embodiment of the electric power actuator gas line 7 may be excluded, causing one port of valve 8 to be connected to ambient air, the inlet of compressor 2 to be connected to ambient air, and one port of control valve 3 to be connected to ambient air, in which case the gas medium of pneumatic control circuit 19 would be ambient air, creating an open pneumatic system.

At the point in which the pressure in accumulator 2 reaches a value of $P_A$ the system will be primed for the operation of actuator 4. Control valve 3 is operated by some user, in response to a pneumatic signal, an electronic control signal, or any other such signal or control mechanism which, when activated, forces control valve 3 to transition into the position shown in the rightmost box of the symbol denoting control valve 3 in FIG. 3. While in this new position, compressed fluid or gas will flow from accumulator 2 through gas line 10 into regulator 11 through gas line 6 into control valve 3 and through gas line 12 into chamber 13 of actuator 4. The compressed fluid or gas introduced into chamber 13 applies a force on piston 14 causing the piston to move leftwards with respect to the illustrated schematic. This movement of piston 14 compresses spring 17 while simultaneously expelling the gas present in chamber 15 out of chamber 15 into gas line 18 and through control valve 3 into gas line 7. If optional gas line 7 is excluded as described previously, gas will be expelled from control valve 3 and vented to ambient air.

In the embodiment shown in FIG. 3 with gas line 7 being included, when actuator 4 transitions from the state of chamber 13 being filled with compressed gas to a pressure of $P_c$ and control valve 3 being positioned as illustrated by the rightmost box of the symbol describing control valve 3 to control valve 3 being positioned in the configuration illustrated (leftmost), the pressurized gas from chamber 13 will undergo a natural response in which the pressure of chambers 13 and 15 will equalize. This equalization in pressure of each chamber within the cylinder of actuator 4 will cause the net force due to gas pressure on either side of piston 14 to become zero, leaving the force generated by previously compressed spring 17 to act on piston 14, thereby biasing the piston in the direction of the force applied by spring 17. This force applied on piston 14 causes actuator 4 to change the state of valve 16 to either open or closed, depending on the previous state of valve 16. And the compressed gas that is now stored in both chambers 13 and 15 is fed back through gas lines 12 and 18 into control valve 3, through gas line 7, and into the inlet of compressor 1. The aforementioned sequence of events will cause a control circuit to energize compressor 1 and configure valve 8 to the illustrated position, causing the cycle of previously described operational events to continue. There is a significant advantage to the closed pneumatic system embodiment of the electric power actuator described herein. Due to the compressed gas acting as a pressurized gas supply for the inlet of compressor 1, compressor 1 only needs to overcome a smaller pressure differential during the time in which it is supplying compressed gas to accumulator 2. This smaller pressure differential allows for shorter time periods of compressor energization and increased power efficiency when compared to an open pneumatic system.

Figure 4:
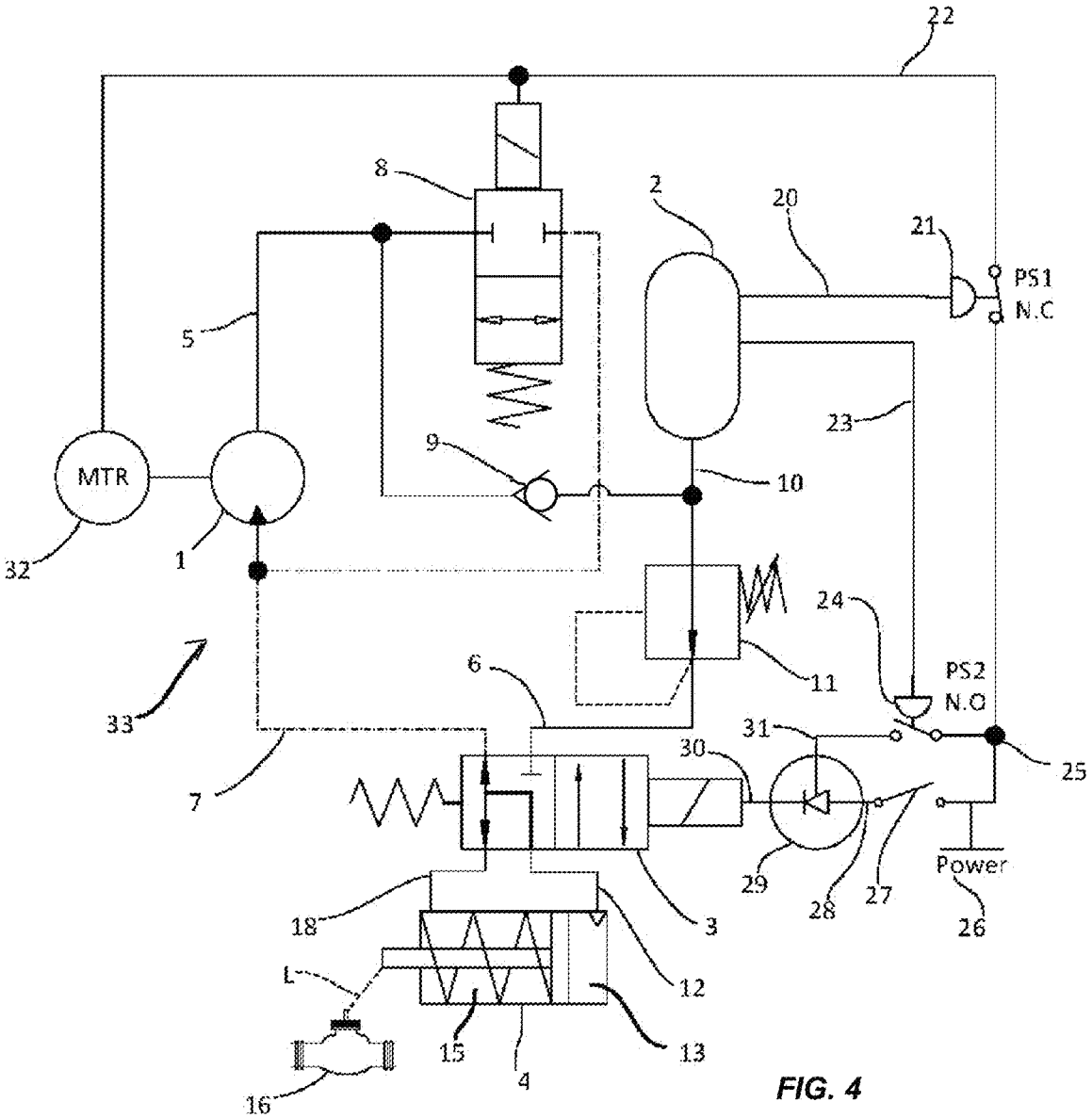
FIG. 4 is a schematic illustration of a pneumatic control system depicting an embodiment of an electric power actuator that includes an electrical control circuit.

Referring next to the system in FIG. 4, illustrated therein is a schematic diagram of a pneumatic control circuit 33, which is an extension of the embodiment of the electric power actuator described in FIG. 3. This extension illustrates an example of one possible electrical control circuit that may be included to operate pneumatic control circuit 33. Compressed gas for operating the actuator 4 is delivered from compressor 1 via pneumatic control circuit 33. Compressor 1 is powered by motor 32, which is energized by power supply 26, which is electrically connected to motor 32 by wire 22, pressure switch 21 (PS1-NC) and wire 25. In the various embodiments, power supply 26 may be an AC to DC rectifier, however, any power supply which can sufficiently energize all the components of the electric power actuator may be used. A two-port valve 8 is connected in parallel to motor 32 as illustrated. While pressure switch 21 is closed, both motor 32 and valve 8 are energized. However, it will be appreciated that in an alternative embodiment of the electric power actuator, an additional pressure switch (PS2-NO) may be included in series with pressure switch 21, which is provided with a pneumatic control signal corresponding to the pressure present in gas line 7. The addition of pressure switch PS2 serves to ensure that compressor 1 cannot become energized if the pressure in gas line 7 is below a predetermined value.

In the following discussion, FIGS. 5-10 represent one embodiment of the electric power actuator, whereas FIGS. 11-17 represent an alternative embodiment of the electric power actuator.

Figure 5:
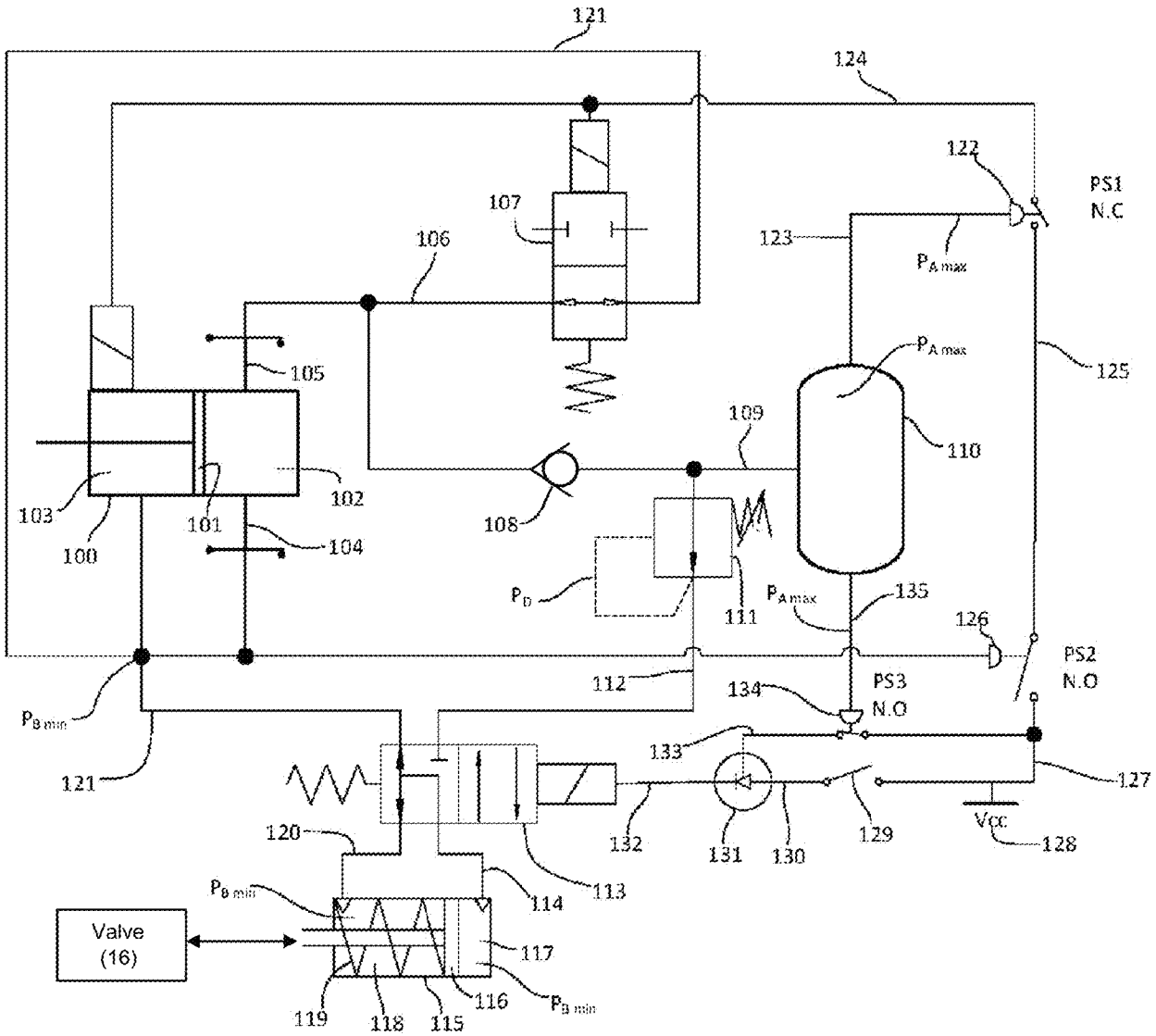
FIGS. 5-7 are schematic illustrations of a pneumatic control system of an electric power actuator in a "charge ready state", an "actuated state" and a "charging state", respectively.
Figure 6:
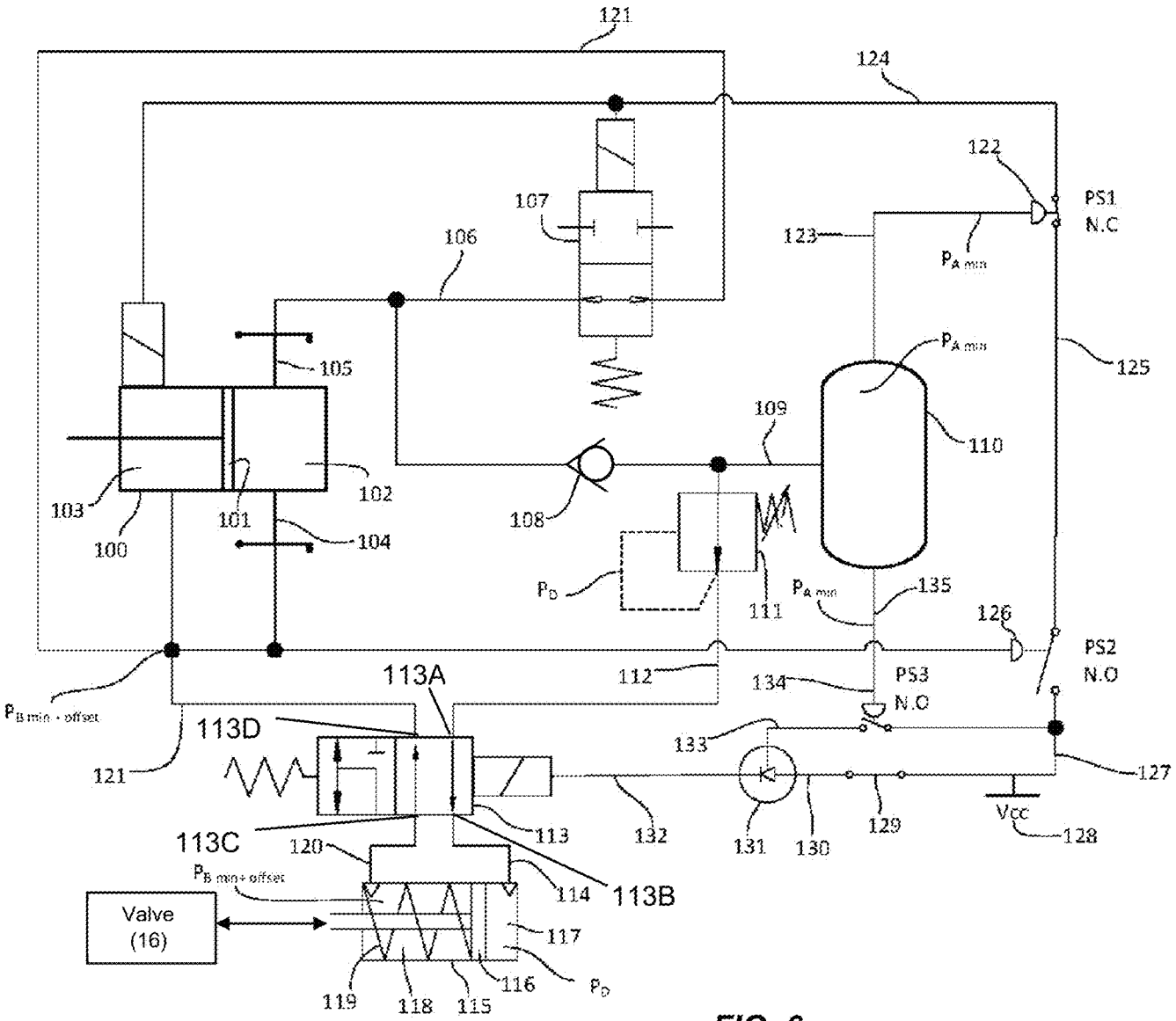
Figure 7:
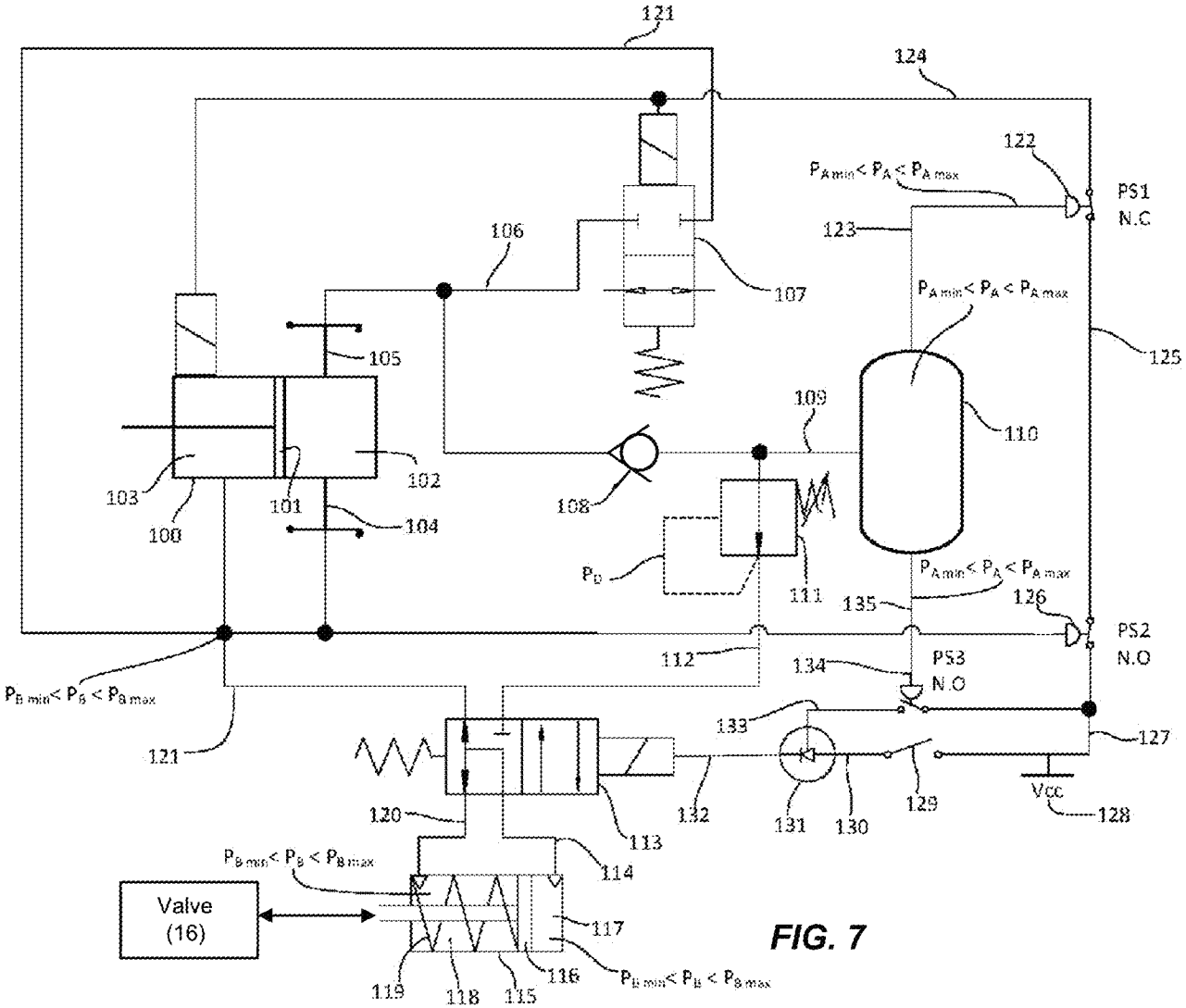

Another possible embodiment of the electric power actuator including the additional pressure switch is illustrated in FIGS. 5-7. Referring to FIGS. 5-7, while compressor 100 is energized, valve 107 is in a closed state, allowing for compressed gas to be directed from outlet 105 of compressor 100 through gas line 106 and check valve 108 into gas line 109. Gas line 109 is also connected to both an accumulator 110 and a regulator 111. Directional control valve 113 remains de-energized while compressor 100 is energized, blocking the flow of gas downstream of regulator 111, causing accumulator 110 to collect the pressurized fluid (gas) delivered from compressor 100.

As gas is provided by compressor 100 and collected in accumulator 110, an increase in pressure occurs within the accumulator. This increased pressure in accumulator 110 acts to provide both pressure switch 122 and pressure switch 134 with a pneumatic control signal via gas line 123 and gas line 135, respectively. These pneumatic control signals act on pressure switches 12 and 134 to either set or reset the pressure switches to open or closed. Pressure switch 122 is a normally closed pressure switch configured to be set to open when the pressure inside accumulator 110 rises to some predetermined value which is sufficient to operate actuator 115 and configured to reset when the pressure in accumulator 110 falls below the aforementioned predetermined value. Pressure switch 134 is a normally open pressure switch that is configured to set and reset at the same predetermined pressure value of pressure switch 122. It will be appreciated that in an alternative embodiment of the electric power actuator a SPDT pressure switch may be used instead of two SPST pressure switches, 122 and 134. This SPDT pressure switch is connected to wire 125 at the single pole, wire 124 being connected at the throw point corresponding to a pressure in accumulator 110 being below the aforementioned predetermined value and wire 133 being connected at the throw point corresponding to a pressure in accumulator 110 being above the aforementioned predetermined value.

At a point in time when the pressure present in accumulator 110 reaches the predetermined value discussed in the last paragraph, pressure switch 122 will set to the open position de-energizing both compressor 100 and valve 107. At this same time, pressure switch 134 will become set to closed, energizing the gate of SCR 131. SCR 131 is a silicon-controlled rectifier that creates the condition that valve 113 can only become energized if accumulator 110 has reached a supply pressure sufficient to set pressure switch 134 to closed. Switch 129 is a SPST switch connected in series with power supply 128 and the anode of SCR 131. It will be appreciated that in an alternative embodiment of the electric power actuator, switch 129 may be any type of switch that acts to open and close the series circuit, which provides current to the anode of SCR 131, such as, for example, an electronically controlled switch like a relay, a silicon-controlled switch, a mechanically operated push-button, etc. At any point in time while pressure switch 134 is set to closed, if switch 129 becomes closed, then directional control valve 113 will become energized, causing control valve 113 to transition into its solenoid powered position.

Once directional control valve 113 has transitioned into its solenoid powered position, the compressed fluid (gas) stored in accumulator 110 will flow from the accumulator through gas line 109 into regulator 111, and then through gas line 112 into a first port 113A of control valve 113, out second port 113B and through gas line 114 and into chamber 117 of actuator 115 via a first port of the actuator. The release of compressed gas from accumulator 110 into chamber 117 causes the opening or closing of valve 16 as discussed in the description of FIGS. 3-4. This release of compressed gas from accumulator 110 also causes a decrease in the pressure stored in accumulator 110, causing pressure switch 134 to open, de-energizing the gate of SCR 131. Although the gate of SCR 131 now becomes de-energized, current will continue to flow through the solenoid circuit of directional control valve 113, allowing the valve to hold its position until switch 129 is set to open by some external control signal de-energizing the anode of SCR 131, at which point control valve 113 will return to its nominal, spring-powered position. While directional control valve 113 remains in the spring powered position, chambers 117 and 118 of actuator 115 will equalize in pressure, as previously described and illustrated in FIG. 3.

Figure 8:
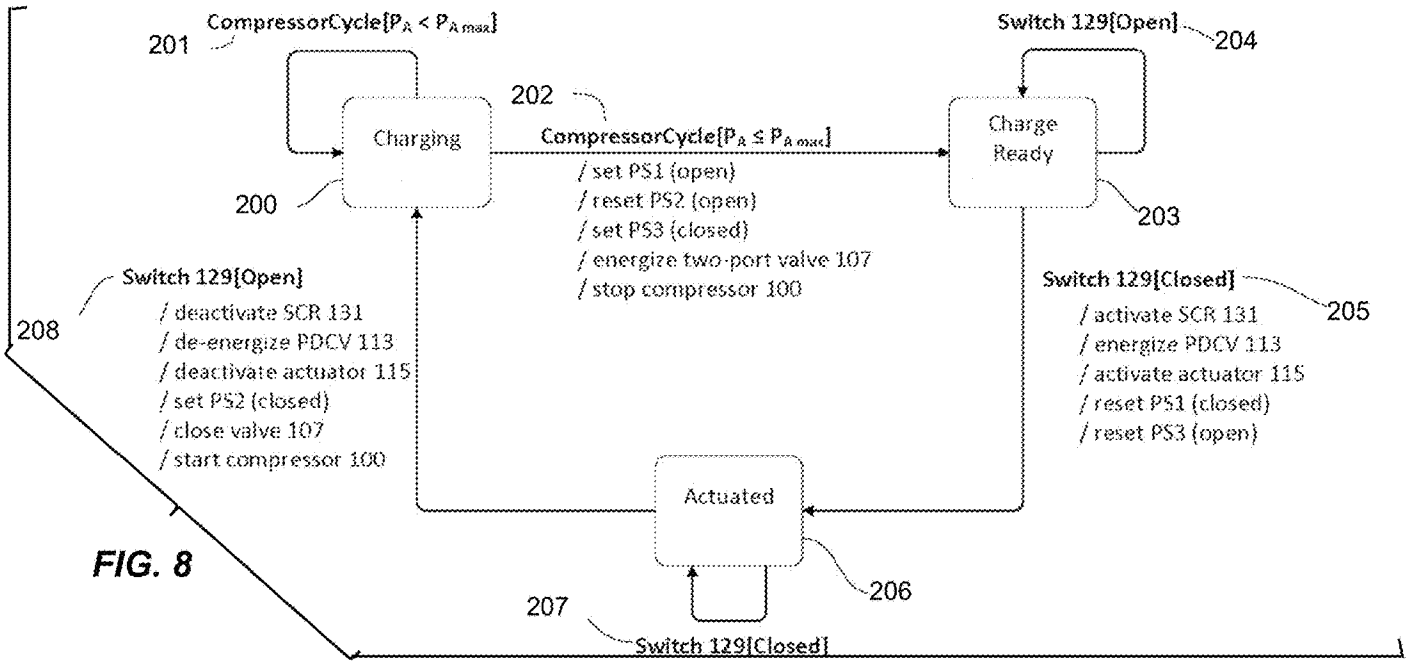
FIG. 8 is a state transition diagram illustrating the characteristics of the states and state changes of the embodiments corresponding to FIGS. 5-7.
Figure 9:
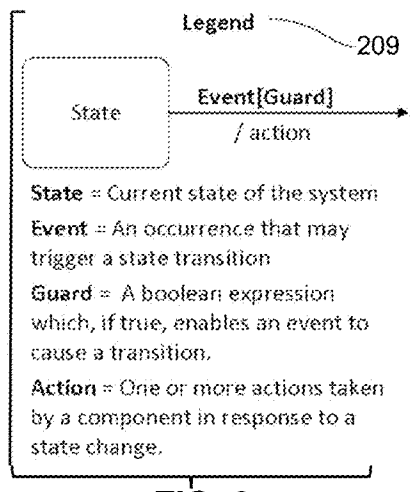
FIG. 9 is the legend of the state transition diagram of FIG. 8.
Figure 15:
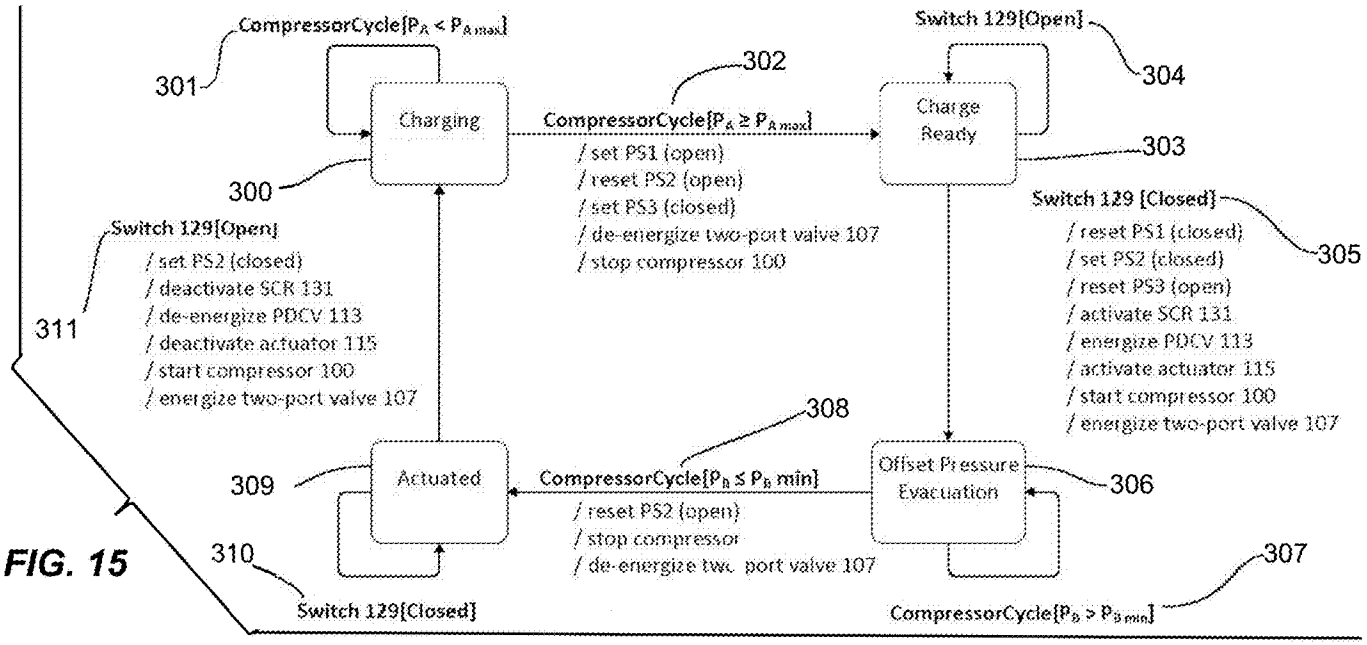
FIG. 15 is a state transition diagram illustrating the characteristics of the states and state changes of the embodiment of the electric power actuator corresponding to FIGS. 11-14.
Figure 16:
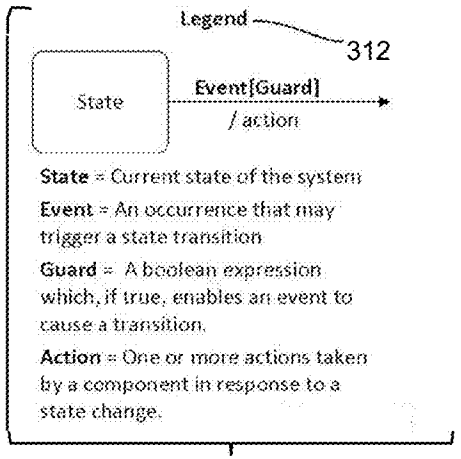
FIG. 16 is the legend of the state transition diagram of FIG. 15.

The following description is directed to alternative embodiments of the electric power actuator and addresses the alternatives by presenting their respective operation using state transition diagrams. Referring briefly to FIGS. 8-10 and 15-17, depicted therein are state transition diagrams for both alternative embodiments, the schematics for which are found at FIGS. 5-7 and 11-14, respectively. In both state transition diagrams, the charging states 200, 300 include a compressor cycle represented as 201, 301, where the control system operates the compressor 100 to assure a pressure ($P_A$) is maintained in accumulator 110, where $P_A$ is below a maximum pressure. Each system transitions from the charging state 200, 300 to a charge ready state 203 via transition 202, 302, where the operations indicated in the respective figures are performed. Referring also to FIGS. 5-7 and 11-14, which represented the alternative embodiments, in charge ready states 203 and 303, as depicted in FIGS. 8 and 15 respectively, normally closed pressure switch (PS1) 122 and normally open pressure switch (PS3) 134 monitor the pressure of accumulator 110 through the connections of gas line 123 and gas line 135, respectively. Both pressure switches 122 and 134 are configured to be set when the pressure in accumulator 110 rises to a pressure greater than or equal to $P_{A\ max}$. The electrical contacts of pressure switch 122 are connected in series with wire 124 which provides power to both control valve 107 and reciprocating piston gas compressor 100. The electrical contacts of pressure switch 134 are connected in series to wire 133, which provides power to the gate of silicon-controlled rectifier (SCR) 131. While in this state, gaseous fluid such as air is stored in accumulator 110 at a pressure corresponding to $P_{Amax}$, thereby forcing pressure switch 122 to be in the open position, causing compressor 100 and valve 107 to be de-energized, and pressure switch 134 to be in the closed position and thus energizing the gate of SCR 131. Pressurized fluid (e.g., gas) is free to flow between gas line 121 and gas line 106 through valve 107 in its de-energized state. SPST switch 129 remains open while in charge ready states 203 and 303, causing two position directional control valve 113 to be de-energized and remain in the valve position illustrated, respectively, in FIGS. 5 and 11. It should be noted that although switch 129 is a SPST mechanically operated switch in this embodiment, switch 129 can be any type of switch mechanically or electrically operated which accomplishes the task of opening and closing the connection between wire 127 and wire 130. In this state, fluid flow directed from accumulator 110 is blocked by check valve 108 and directional control valve 113. A spring-return pneumatic actuator 115 rests in the closed position defined by the pressure in chamber 117, chamber 118, gas line 114, gas line 120 connected to a second port (vent) of the actuator, and gas line 121 being equal at a pressure of $P_{Bmin}$ and piston 116 being in the rightmost position as depicted in the respective figures. In this closed position, spring 119, within actuators 115, acts on pistons 116 to force piston 116 to be in the rightmost position. Normally open pressure switch (PS2) 126 monitors the pressure in gas line 121. Pressure switch 126 is configured to reset when the pressure in gas line 121 falls below or equal to $P_{min}$. The electrical contacts of pressure switch 126 are connected in series with power supply 128 and wire 124, causing compressor 100 and valve 107 to be de-energized when $P_B$ falls below $P_{B\ min}$. The system will remain in respective charge ready states 203 and 303 indefinitely while switch 129 remains open as illustrated in the state transition diagrams by switches 129 state events 204 and 304.

If switch 129 becomes closed while the system is in a charge ready state (203 or 303), the system will begin a state transition as represented by 205 and 305. The closing of switch 129 allows electric current to flow through SCR 131 from power supply 128, energizing valve 113 and placing it in the valve position illustrated in FIG. 6, for example. In this new valve position, gaseous fluid stored in accumulator 110 flows through pressure reducing regulator 111, through valve 113, and into chamber 117 of actuator 115. Pressure in chamber 117 is initially at $P_{Bmin}$ and rises to downstream pressure $P_D$ as regulated by regulator 111. As pressure rises in chamber 117, force is exerted on piston 116, causing piston 116 to move leftwards and spring 119 to become compressed. A typical application of this embodiment would include actuator 115 being operatively (e.g., mechanically) coupled to a valve 16 such as a ball or butterfly valve. The movement of piston 116 due to the pressure rise in chamber 117 would cause this ball or butterfly valve to either open or close, as is common with single acting pneumatic actuators. Chamber 118 is initially at a pressure of $P_{Bmin}$. The movement of piston 116 causes a decrease in volume of chamber 118 resulting in an increase of pressure in chamber 118. Due to the flow of high-pressure gaseous fluid from accumulator 110 into the lower pressure chamber 117 of actuator 115, the initial pressure, $P_{Amax}$, of accumulator 110 will drop to a lower pressure $P_{Amin}$, which is greater than $P_D$. This drop in pressure causes pressure switch 122, which is configured to close at a falling pressure of less than $P_{Amax}$, to close and pressure switch 134, which is configured to open at a falling pressure of less than $P_{Amax}$, to open. The opening of pressure switch 134 de-energizes the gate of SCR 13, however, current continues to flow through SCR 131 into directional control valve 113 due to the nature of a silicon-controlled rectifiers ability to behave as a latching power switch.

In the embodiment of the electric power actuator depicted by FIGS. 5-10, the state transition shown in FIG. 8 from charge ready state 203 to actuated state 206, as a result of the state transition event 205, results in the state depicted by the schematic drawing of FIG. 6. The final pressure of chamber 118 in actuated state 206 is equal to $P_{B\ min+offset}$. $P_D$, the pressure in chamber 117 must be set by regulator 111 to a value that is greater than the minimum pressure required to operate actuator 115, plus the value of $P_{Bmin+offset}$. In other words, if the spring-return pneumatic actuator 117 used in the system requires an operating pressure of say 60 psi on piston 116 and $P_{B\ min+}$offset is equal to 15 psi, then regulator 111 must be set to provide a pressure $P_D$ of at least 75 psi. The system will remain in actuated state 206 indefinitely while switch 129 remains closed as illustrated in the state transition diagram of FIG. 8 by state event 207.

Figure 12:
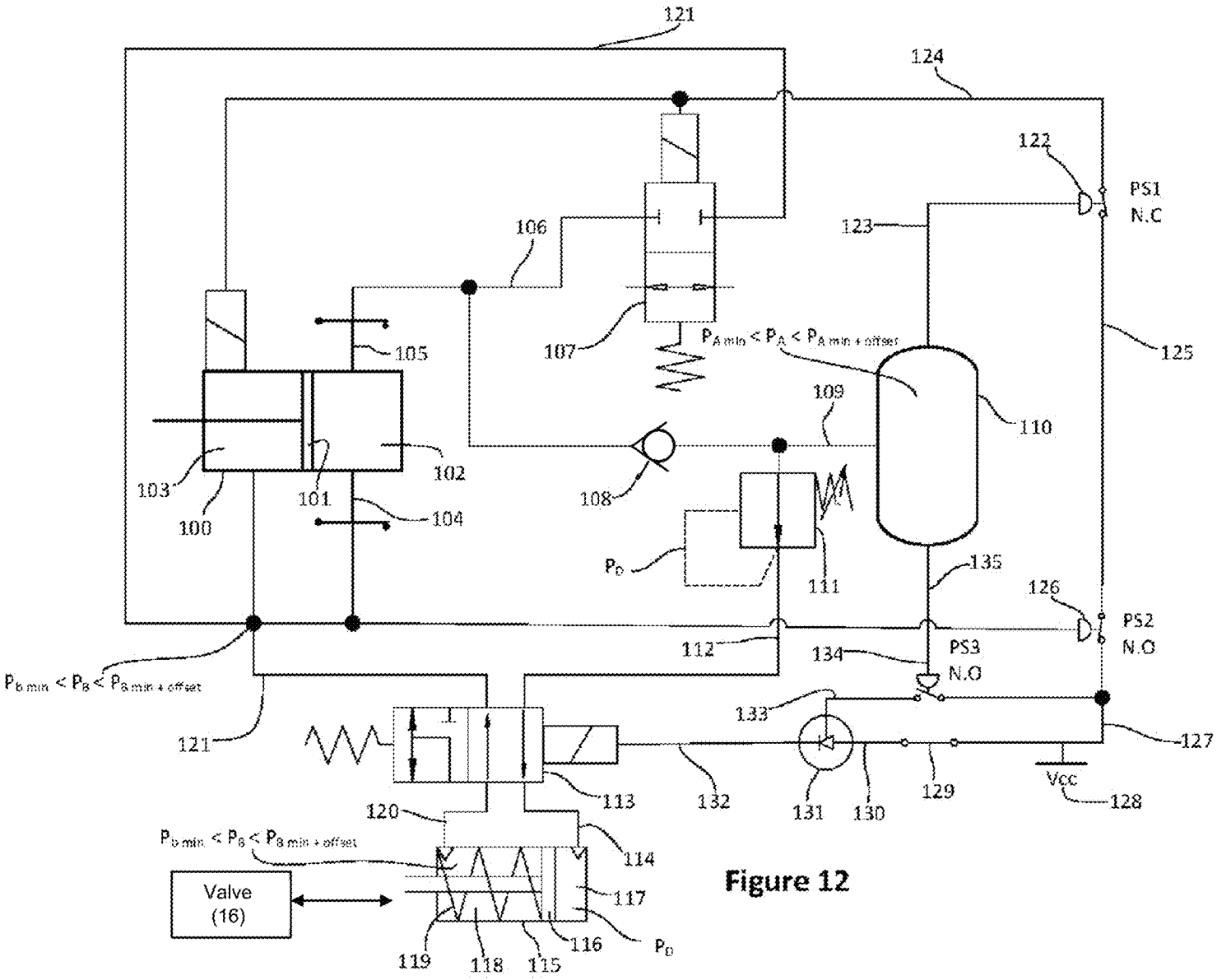

In the alternative embodiment of the electric power actuator depicted by FIGS. 11-17, the state transition shown in FIG. 15 from charge ready state 303 to offset pressure evacuation state 306, as a result of state transition event 305, results in the state depicted by the schematic drawing of FIG. 12. In this embodiment, pressure switch 126 is configured to set at a rising pressure of greater than $P_{Bmin}$. The increase in pressure of chamber 118 will cause gas line 121 to also increase in pressure, setting pressure switch 126 closed. The closing of pressure switch 126 completes the series circuit that provides power to compressor 100 and valve 107, energizing both components. Valve 107 will transition into the position illustrated in FIG. 12 while compressor 100 will begin pumping gaseous fluid from chamber 118 through directional control valve 113 and into gas line 106. The fluidic output of compressor 100 causes a rise in the pressure of gas line 106 until the pressure in line 106 becomes greater than the pressure within accumulator 110, at which point the fluidic output of compressor 100 will flow through gas line 106, through check valve 108 and into accumulator 110. Compressor 100 will continue to cycle until the pressure in gas line 121 falls below or equal to the value of $P_{Bmin}$ as depicted in FIG. 15 by compressor cycle state event 307. It should be noted that the event CompressorCycle[ ] is characterized as a full cycle of compressor 100, where piston 101 completes a full period of motion, forcing gaseous fluid from gas line 121 through inlet 104 and out outlet 105. At the point in which the pressure in gas line 121 falls below or equal to $P_{Bmin}$, pressure switch 126 will reset to open, de-energizing both valve 107 and compressor 100, as well as forcing the system into actuated state 309 as shown by compressor cycle state event 308. The de-energizing of valve 107 causes an equalization in pressure of gas line 106 and gas line 121. The system will remain in actuated state 309 indefinitely while switch 129 remains closed as illustrated in FIG. 15 by switch 129 and state event 310.

Figure 13:
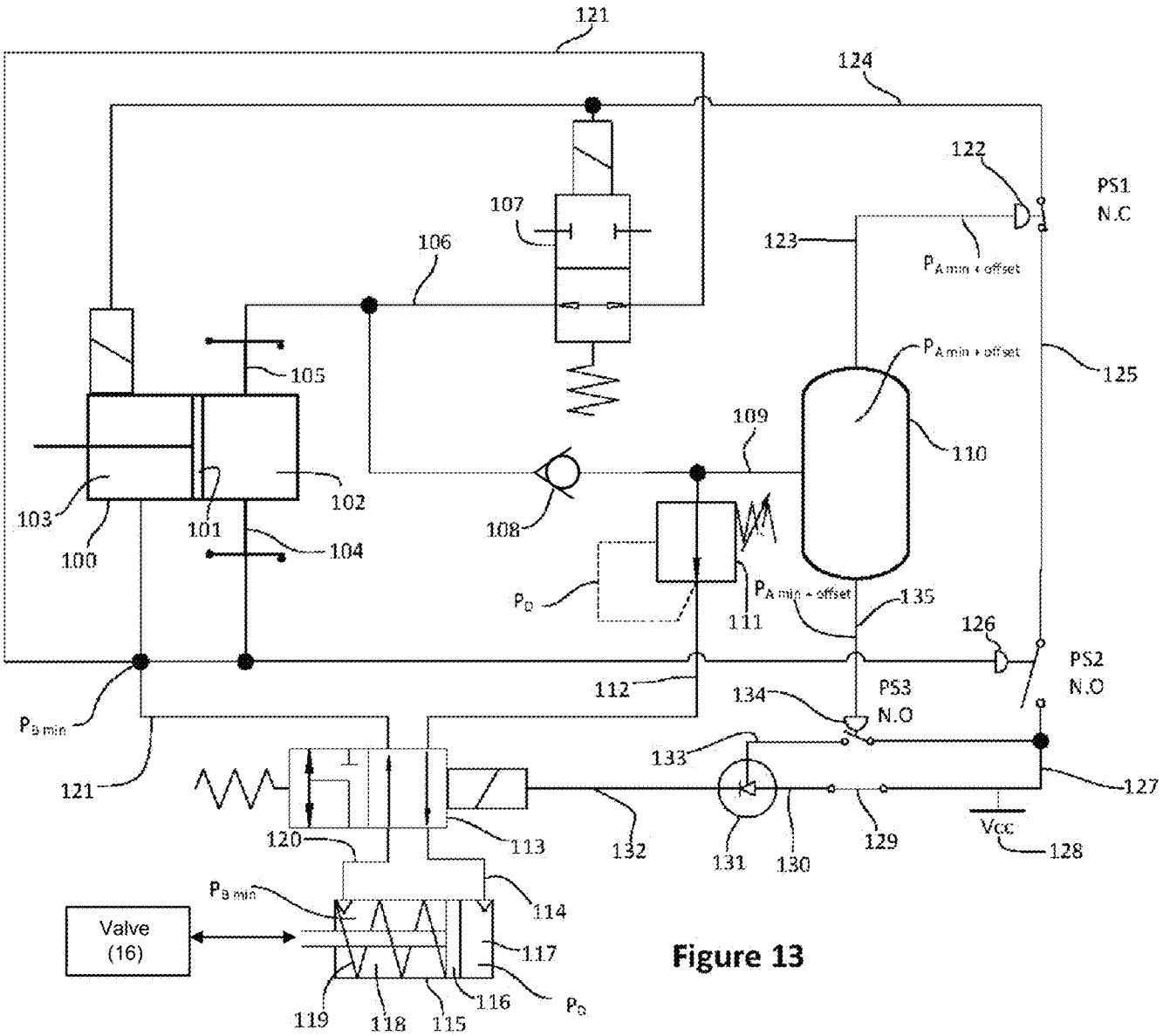
Figure 14:
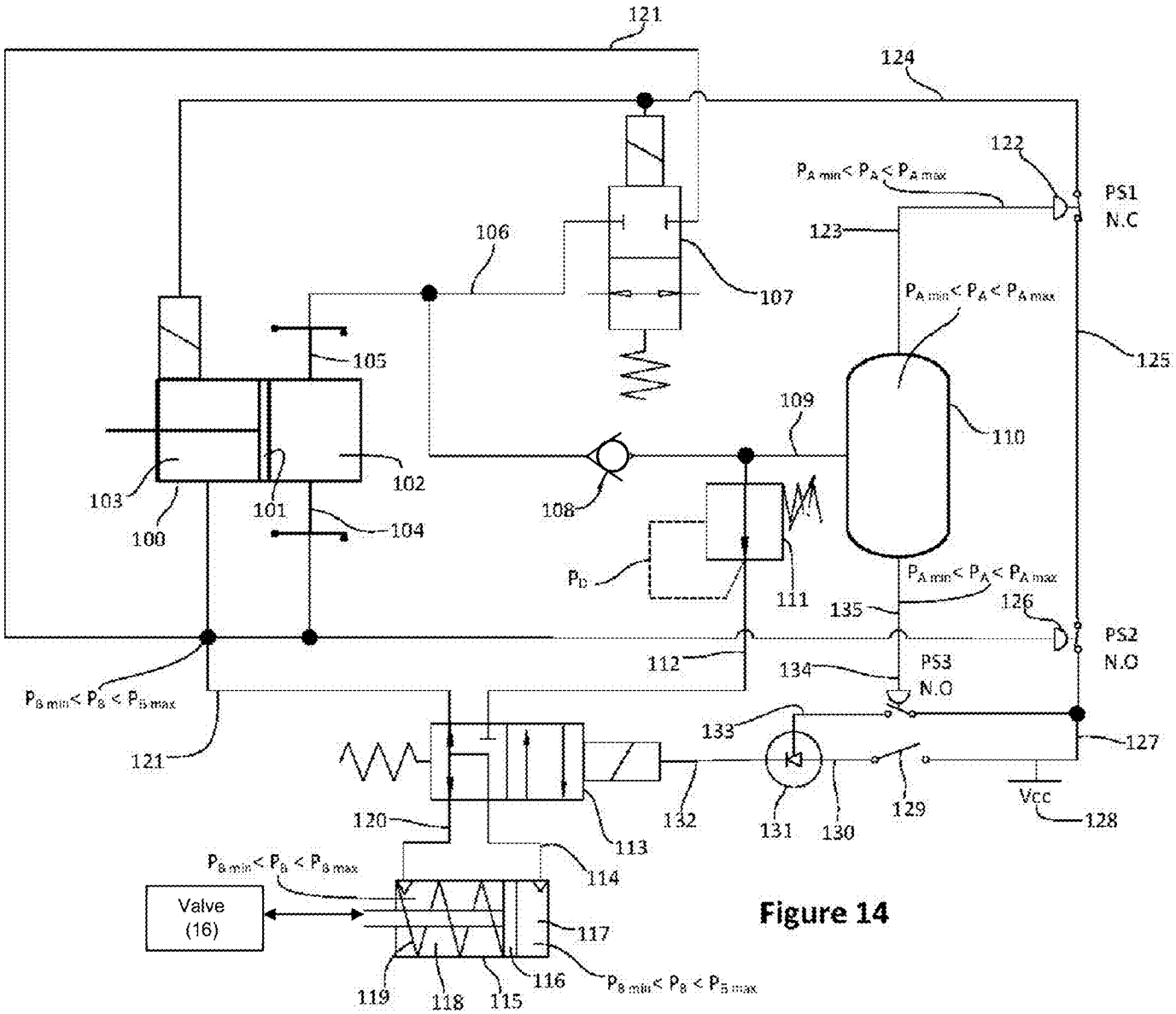

Referring now to FIG. 13, actuated state 309 is almost identical to actuated state 206, depicted in FIG. 6; the only difference being the set pressure of pressure switch 126. In the embodiment described in FIGS. 5-10 pressure switch 126 is configured to set at a rising pressure of greater than $P_{Bmin+offset}$ whereas the embodiment represented in FIGS. 11-17 configures pressure switch 126 to set at a rising pressure of greater than $P_{Bmin}$. Notably, the difference in the embodiments depicted does not directly affect the remaining states in FIGS. 8 and 15, therefore the following description pertains to both embodiments unless otherwise noted.

A state transition from actuated state 206 or 309 to charging state 200 or 300 will occur during switch 129 state event 208 or 311. This state event is characterized by switch 129 becoming open while the embodiment is in its actuated state. After the opening of switch 129, SCR 131 and directional control valve 113 will become de-energized, forcing control valve 113 into the spring powered position illustrated in FIGS. 7 and 14. The new positioning of valve 113 will cause chamber 118, initially at $P_{Bmin}$, and chamber 117, initially at $P_D$, to become connected and equalize at a pressure, $P_B$. Due to this equalization in pressure between chambers 117 and 118, the net force due to pressure on the left and right side of piston 116 will become zero, causing the only active force on the piston to be due to spring 119. This active force of spring 119 will cause piston 116 to move rightward, forcing gaseous fluid from chamber 117 into gas line 114 through valve 113 and gas line 120, into chamber 118. This process effectively moves actuator 115 from the open position to a closed position. The increase in pressure in gas line 121 will cause pressure switch 126 to set closed, energizing valve 107 and compressor 100. At this point it should be noted that the connection of chamber 117, chamber 118, gas lines 114, 120, 121, and valve 113 act as a gas supply to compressor inlet 104. It should also be noted that gas line 121 is connected to chamber 103 of compressor 100 in order to equalize the pressure on either side of piston 101, thereby allowing compressor 100 to begin drawing gaseous fluid from gas line 121 into inlet 104 out of outlet 105 and into gas line 106 without having to overcome an increased head pressure.

Figure 10:
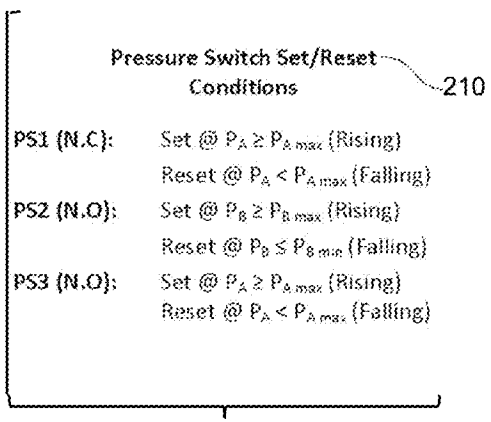
FIG. 10 illustrates the set/reset pressure values of the switches included in the embodiments represented by FIGS. 5-9.
Figure 11:
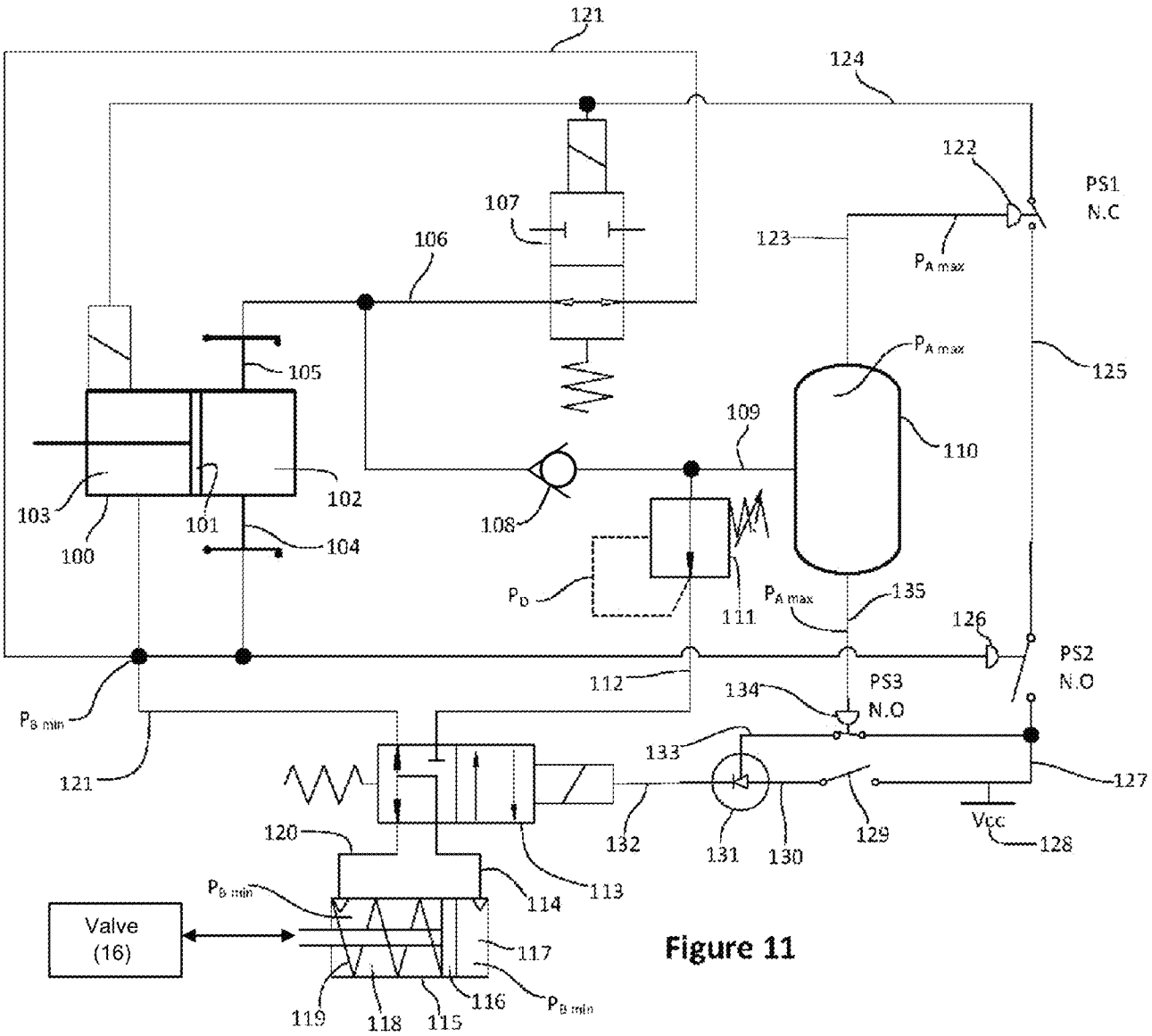
FIGS. 11-14 are schematic illustrations of a pneumatic control system of an electric power actuator in a "charge ready state", an "offset pressure evacuation state", an "actuated state", and a "charging state", respectively.

As illustrated in respective FIGS. 7 and 10, valve 107 being in the closed position causes pressure to build in gas line 106 due to the fluidic output of compressor 100, until the pressure in gas line 106 exceeds the pressure in gas line 109, at which point gaseous fluid will begin to flow from compressor 100 through gas line 106 through check valve 108 and into accumulator 110, through gas line 109, causing the pressure in accumulator 110 to increase. Compressor 100 continues to cycle until the point in which the pressure in accumulator 110 ($P_A$) rises to greater than or equal to $P_{Amax}$ at which point pressure switch 122 will become set to open or until the pressure in gas line 121 ($P_B$) falls to less than or equal to $P_{Bmin}$. These aforementioned conditions ideally happen simultaneously, however, as long as pressure switch 122 becomes set, the system will be forced into a state change as illustrated in FIGS. 8 and 15 by compressor cycle event 202. At the point in which pressure switch 122 becomes set to open, pressure switch 134 will also become set to closed, as illustrated in the actions of the state transition diagram depicted in FIGS. 8 and 11 within compressor cycle event 202. The setting of pressure switch 122 to open will de-energize both compressor 100 and valve 107 as well as force a state transition into charge ready state 203 and 303, as illustrated in the state transition diagrams of FIGS. 8 and 15.

Figure 17:
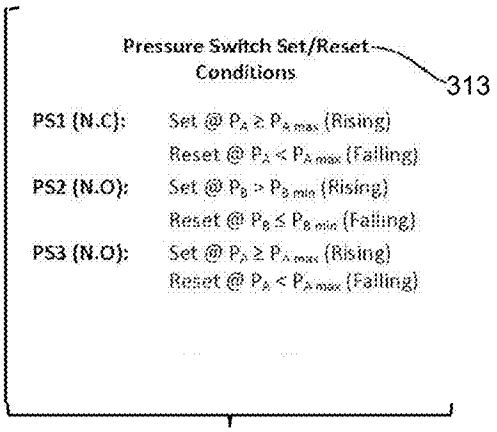
FIG. 17 illustrates the set/reset pressure values of the switches included in the embodiments represented by FIGS. 11-16.

Pressure switch set and reset conditions for pressure switches 122, 126, and 134 are shown in FIGS. 10 and 17. The parameters of FIG. 10 correspond to the embodiment described in FIGS. 5-9 whereas the parameters of FIG. 17 correspond to the embodiment described relative to FIGS. 11-16.

Figure 18:
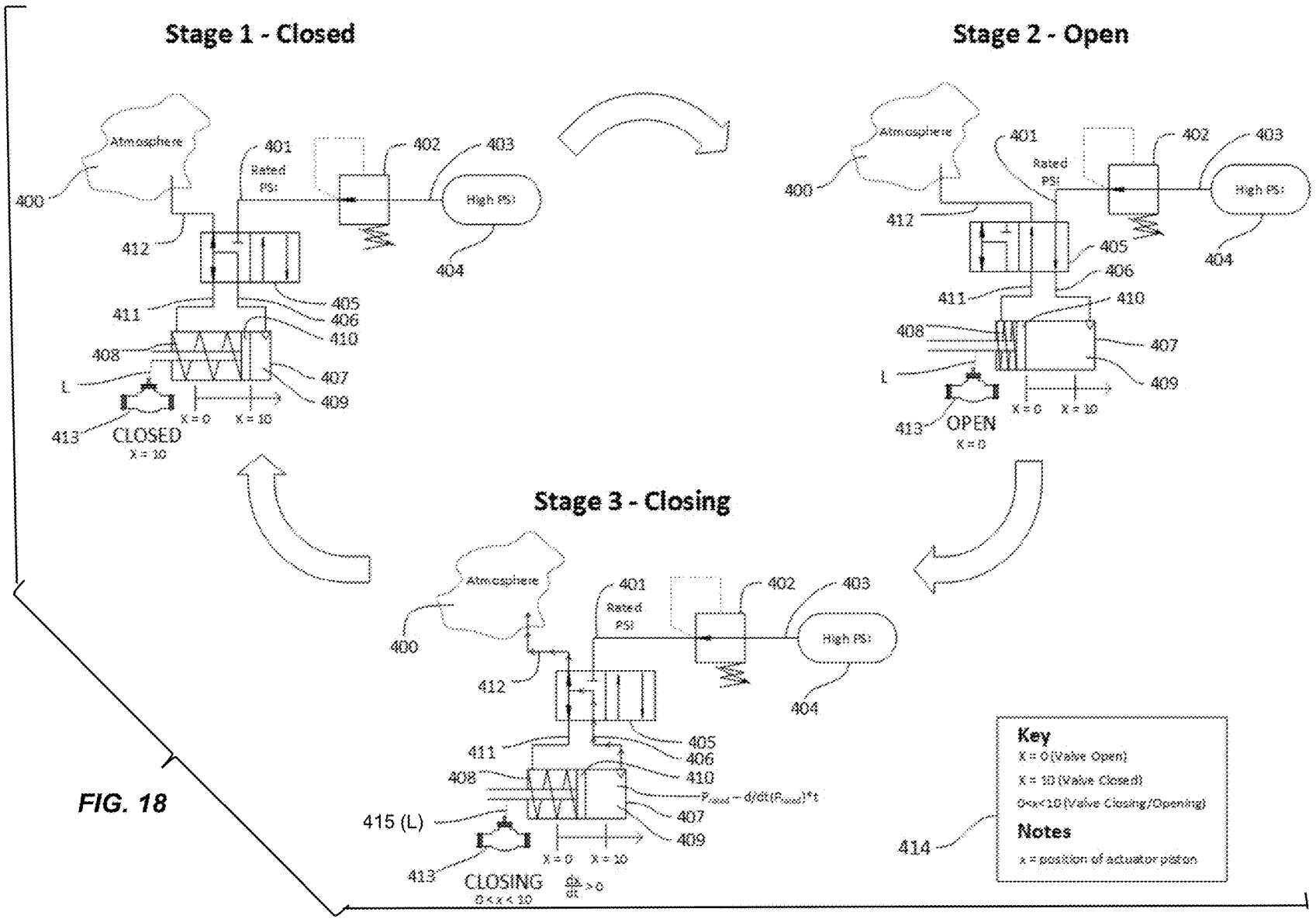
FIG. 18 is a schematic and state transition illustration depicting the common operation of a single acting pneumatic actuator.
Figure 20:
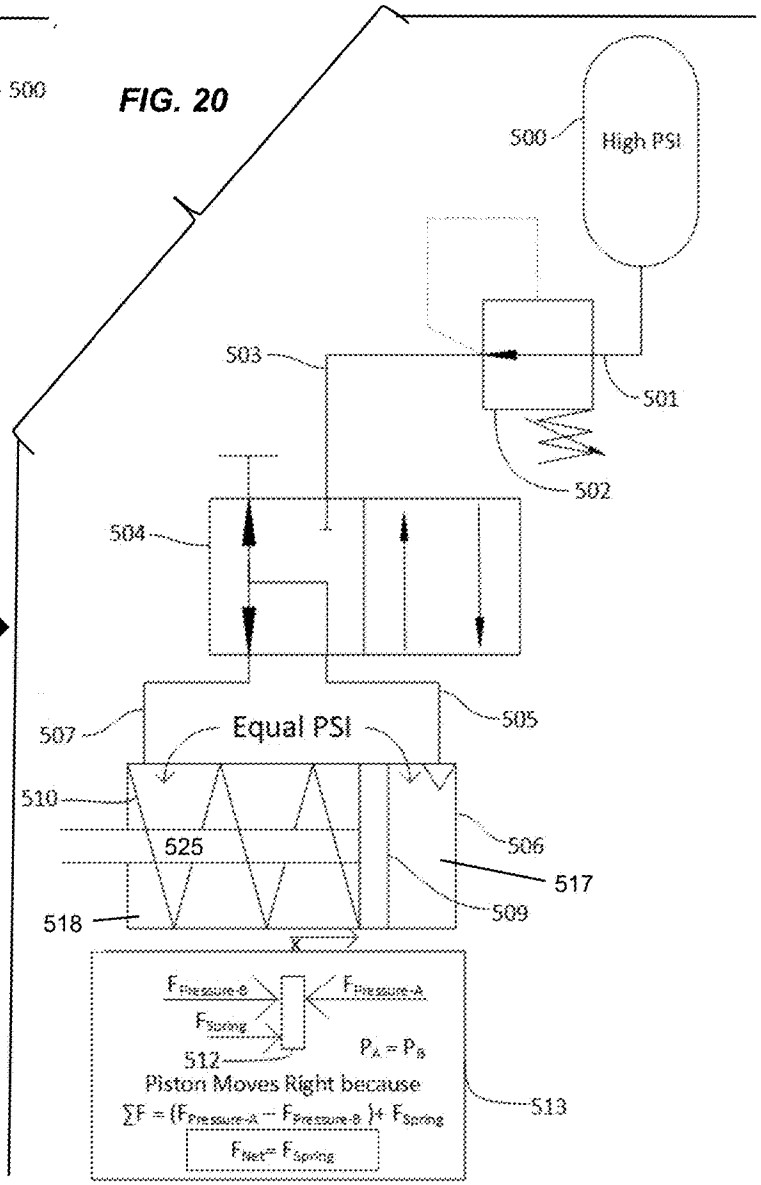
FIGS. 19-20 are schematic illustrations of a single acting pneumatic actuator pneumatic circuit with modifications.
Figure 19:
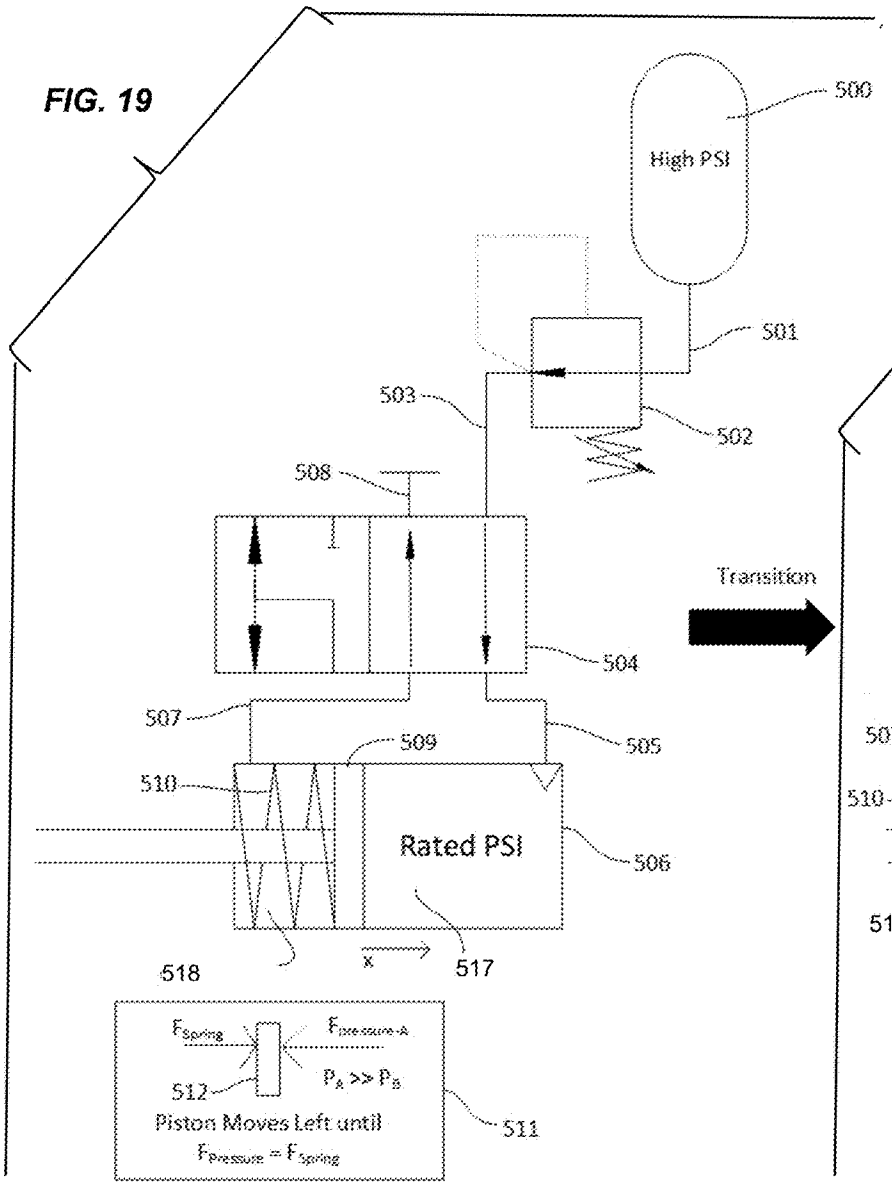

Turning next to FIGS. 18-20, illustrated therein is a method in which the electric power actuator utilizes a single acting actuator. More specifically, FIG. 18 represents the typical operation of an exemplary pneumatic actuator 407 having a stem mechanically coupled to a fluid control valve 413 by a mechanical link system 415 (L) as it is typically implemented in a fluid valve control system. The common configuration shown comprises a gas accumulator 404 connected in series via gas line 403 to a pressure reducing gas regulator 402. Accumulator 404 is commonly pressurized via a gas compressor (not shown) drawing air from the surrounding atmosphere. Regulator 402 acts to step down the pressure in accumulator 404 to the rated pressure required for operation of actuator 407. Regulator 404 is connected downstream to a directional control valve 405 via gas line 401. Directional control valve 405 acts to control and redirect the flow of gas supplied by accumulator 404 to actuator 407 via gas lines 406 and 411. During normal operation, pressurized gas is directed from accumulator 404 to chamber 409 of actuator 407 through the illustrated pneumatic circuit. The pressurized gas directed into chamber 409 acts to create a force due to pressure in the −x direction which overcomes the force due to a spring 408 in the +x direction, moving piston 410 in the −x direction and compressing spring 408. As piston 410 moves in the −x direction, valve 413 opens due to the mechanical coupling 415 (L) as shown in the Stage 2—Open portion of FIG. 18.

Under normal operating conditions, valve 413 is meant to be transitioned from an open to closed state via the mechanical coupling 415 (L), which operatively connects actuator 407 to valve 413. In order to accomplish transitions from open to closed and vice versa, directional control valve 405 commonly receives a signal from a control source such as a signal from a computerized control system, which initiates a change to the position of control valve 405. The control valve illustrated in FIG. 18 is a 4-way, 2-position control valve, however, any control valve that effectively controls fluid flow to regulate the pressure in the chambers of actuator 407 may be used. During the state transition from open to closed, directional control valve 405 is positioned as illustrated in FIG. 18, particularly Stage 3—Closing. After transitioning from Stage 2—Open to Stage 3—Closing, directional control valve 405 transitions to the position illustrated by Stage 3—Closing. While in this position, chamber 409 is directly connected to the surrounding atmosphere, which in turn causes the air pressure inside chamber 409 to begin to decrease. As this pressure decrease occurs, the force due to pressure acting on piston 410 in the −x direction caused by the pressure in chamber 409 described in the above paragraph begins to decrease. As this force decreases, due to an equalization of the pressure in chamber 409 and the surrounding atmosphere 400, the force due to the compressed spring 408 overcomes the counter-acting force due to pressure in chamber 409, causing piston 410 to move in the +x direction and venting the pressurized air in chamber 409 to atmosphere through control valve 405 as illustrated in FIG. 18. As piston 410 moves in the +x direction, valve 413 closes due to mechanical coupling 415 (L). At the point in which spring 408 has moved piston 410 to its maximum +x distance, actuator 407 transitions back into Stage 1—Closed where it will stay indefinitely until control valve 405 receives a signal to transition the position of control valve 405 from the position illustrated in Stage 1—Closed to the position illustrated in Stage 2—Open.

Turning next to paired FIGS. 19-20, FIG. 19 illustrates a key principle of the electric power actuator. FIG. 19 presents a simplified schematic drawing of FIG. 18 where gas line 508 is analogous to gas line 412 and control valve 405 is analogous to control valve 504. In the configuration shown in FIG. 19, gas line 508 terminates in a dead-end opposite of its connection to directional control valve 504 instead of venting to atmosphere as illustrated in FIG. 18 by gas line 412. The force diagram 511 depicts the forces present on piston 509 during Stage 2—Open. As shown in the force diagram 511 of FIG. 19, the force due to pressure in 517, which is analogous to chamber 409 in FIG. 18, causes piston 509 depicted as piston 512 in diagram 511 to move to the left until the force due to compression of spring 510 becomes equal to the force due to pressure of 517 or until piston 509 moves to its maximum x position in the −x direction. Piston 509, and attached stem 525, remains in its maximum x position in the −x direction until control valve 504 is repositioned to the configuration shown by control valve 504, as represented in FIG. 20.

At the point in which control valve 504 in FIG. 19 transitions to the configuration shown by control valve 504 in FIG. 20, actuator 506 will transition to its closed state. As illustrated by the configuration of control valve 504 in FIG. 20, both ports of actuator 504 are connected by gas line 505 and 507 allowing pressurized fluid (e.g., gas) to flow between the two chambers of actuator 506. This connection causes the high-pressure gas in 517 of actuator 506 to equalize with the gas pressure present in 518 as illustrated in FIG. 20. This equalization of pressure causes the force due to pressure on either side of piston 509 to equalize, leaving the force due to spring 510 as the only force acting on piston 509 as represented in the force diagram 513. Because the force due to spring 510 is the only acting force on piston 509 after equalization, piston 509 will move to its maximum position in the +x direction thus transitioning actuator 506 to the closed state.

It should be noted that the electric power actuator described relative to FIGS. 19-20 differs from what is commonly used due to the practice of terminating the control valve port which would normally vent to atmospheric air in a dead end. By terminating the normally vented-to-atmosphere port in a dead end, gas pressurized to a value above atmospheric pressure can be stored within the system while allowing pneumatic actuator 506 to close via spring power. The advantages of this system is discussed below.

Figure 22:
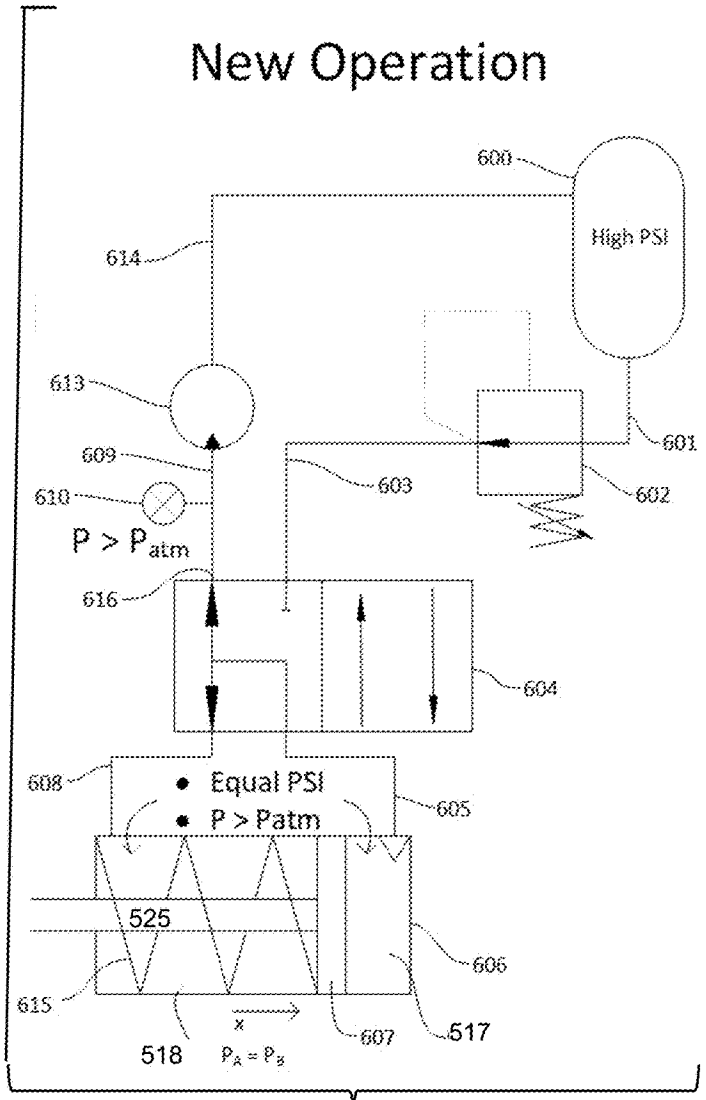
FIG. 22 is a schematic illustration of an electric power actuator that further modifies the system illustrated in FIG. 21.
Figure 21:
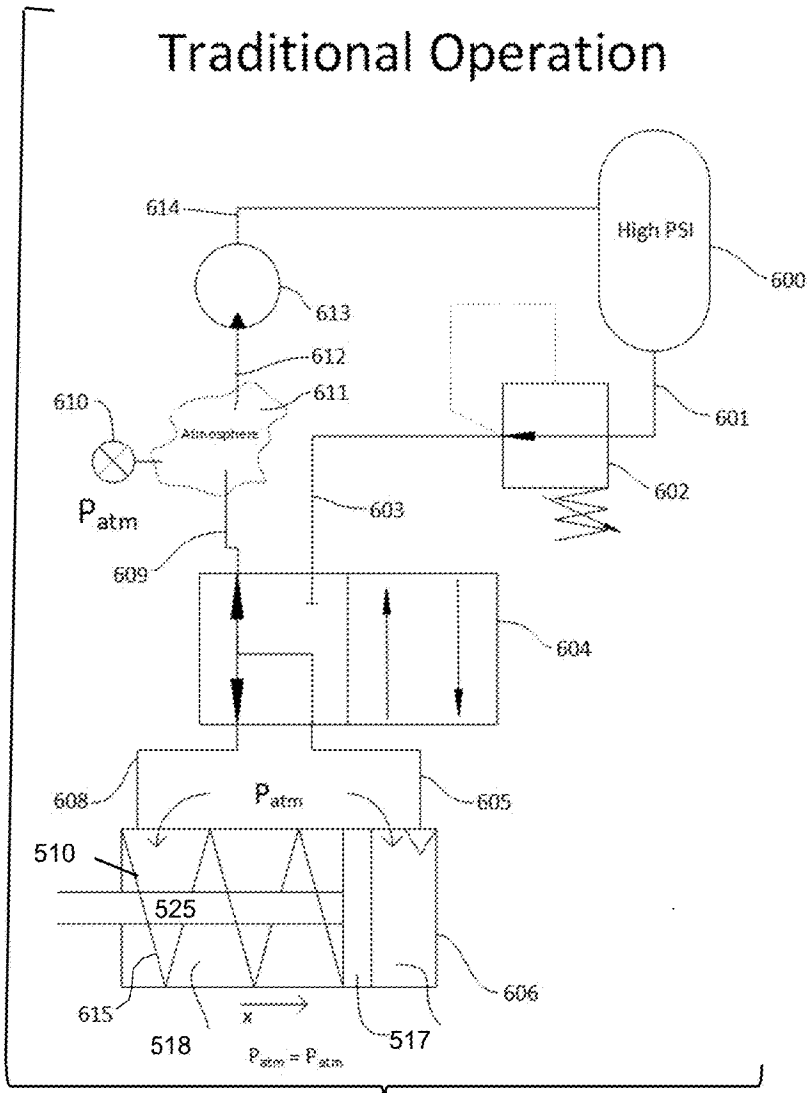
FIG. 21 is a schematic illustration of an exemplary pneumatic circuit used to control single acting pneumatic actuator systems.

The schematic drawings of FIGS. 21 and 22 illustrate the advantages of terminating the venting port of directional control valve 604 in a dead-end connection. As previously described, terminating the port of control valve 604, which would normally be vented to atmosphere in a dead-end, still allows actuator 606 to close via spring power. This configuration provides several advantages over the common configuration.

Traditional operation of a pneumatic actuator circuit is illustrated schematically by FIG. 21. As illustrated, when control valve 604 transitions into the position shown, the spring 510 within actuator 606 applies a force to piston 607 which returns the actuator to its closed state. Because Chamber 517 is directly connected to atmosphere 611 via the connections of gas line 605, directional control valve 604, and gas line 609 the air that was previously pressurized within Chamber 517 undergoes an equalization of pressure with the surrounding atmosphere 611. This causes the force due to pressure within Chamber 517 directed in the −x direction to become equal to the force due to pressure of 518 directed in the +x direction, thus canceling out the net forces due to pressure on piston 607 and leaving only the force due to the compression of spring 615 to act on piston 607 as shown in force diagram 513 in FIG. 20. Because the force due to spring is the only acting force on piston 607, the piston moves to its maximum position in the +x direction.

Operation of any pneumatic actuator includes using a pressurized gas source to pressurize one or more chambers of a pneumatic actuator. This pressurization of an actuator causes the depletion of pressurized gas in the accumulator, which stores the pressurized gas. In order to replenish pressurized gas, a gas compressor is used. It is common for this compressor to draw atmospheric air into its inlet and expel pressurized gas through its outlet into an accumulator. This conventional configuration is shown in FIG. 21. Gas compressor 613 draws air at atmospheric pressure from atmosphere 611, which resides at atmospheric pressure as measured by pressure gauge 610, and then compresses the air to some predetermined value, storing it in accumulator 600. The high-pressure air stored in accumulator 600 is then used to power actuator 606 through the pneumatic circuit shown in FIG. 21 in a manner such as has been described previously.

In contrast, the improved operation described relative to a disclosed embodiment of the electric power actuator utilizes the pneumatic circuit illustrated by FIG. 22. The circuit illustrated in FIG. 22 utilizes a closed loop air transfer system where the port 616 of control valve 604, which would normally terminate in an open connection to atmosphere, is operatively connected to the inlet of gas compressor 613. Although characterized and depicted as a closed loop system, it is also possible to operate the disclosed system as an open loop system that vents to atmosphere, albeit less efficient due to the need to provide make-up air to maintain pneumatic pressure. As previously described relative to FIGS. 19 and 20, this port terminating at a dead-end connection does not interfere with the ability of the spring return actuator 606 to close via spring power. By connecting the vent port 616 of directional control valve 604 directly to the inlet of compressor 613, after the transition from Stage 3—Closing to Stage 1—Closed as represented in FIG. 18, the pressurized gas that previously resided in Chamber 517 cannot be expelled to the atmosphere. This causes an equalization of pressure between Chamber 517 and Chamber 518 of actuator 606, which in turn results in a pressure of the incoming gas that is greater than atmospheric pressure. This increased pressure value represents the gas pressure introduced to the inlet of compressor 613. Compressor 613 is configured to supply accumulator 600 with compressed air up to some predetermined pressure value. Because the air pressure supplied to the inlet of compressor 613 in the configuration illustrated in FIG. 22 is greater than the atmospheric air pressure supplied to the inlet of compressor 613 in the configuration illustrated in FIG. 21, the configuration shown in FIG. 22 will recharge the accumulator to the predetermined pressure vessel significantly faster, and with less energy expended (i.e., greater efficiency), than a conventional configuration as shown in FIG. 21.

When comparing the conventional configuration of FIG. 21 with the embodiment of the electric power actuator described by FIG. 22, several advantages become apparent. The direct connection of venting port 616 of control valve 604 to the inlet of compressor 613 via gas line 609 creates a closed pneumatic circuit system. This offers several advantages including the ability to utilize other gases within the pneumatic circuit, which may have more desirable properties than the typical fluid medium (air) that pneumatic systems operate on. Another advantage is not needing to filter the air supplied to the inlet of compressor 613 as is standard in conventional pneumatic systems of this type. A further advantage of the closed-loop embodiment is the ability to better control moisture content within the system, independent of the environmental conditions in which the system is utilized.

Additionally, there are several other advantages that arise from operating a closed pneumatic system. One advantage of the embodiment of the electric power actuator embodiments disclosed herein is significantly increased efficiency of the pneumatic actuation system. Most pneumatic actuation systems operate under the principle of compressing ambient atmospheric air via a gas compressor, storing that compressed air in an accumulator, transporting that compressed air from an accumulator to a pneumatic actuation chamber where it performs work on the system, and then releasing that compressed air back into the atmosphere via a venting port such as port 616 of directional control valve 604. The compressed air released into the atmosphere, however, is still full of potential energy. By equalizing the pressure between Chambers 517 and 518 of actuator 606 in FIG. 22, for example, much of the potential energy stored in the compressed gas can be recycled by being directed back into the inlet of compressor 613. Because spring return actuator 606, closed via spring power independently of the pressure in Chamber 517 and 518, so long as the pressure in each chamber is equal, the actuator can operate as it normally would. The higher pressure introduced to the inlet of compressor 613 allows the compressor to overcome the pressure difference between the value shown by gauge 610 and the predetermined pressure value desired within accumulator 600 in FIG. 22 much faster than the difference between the value shown by pressure gauge 610 and the predetermined pressure value desired within accumulator 600 in FIG. 21, thereby resulting in greater efficiency of the power system.

Figure 23:
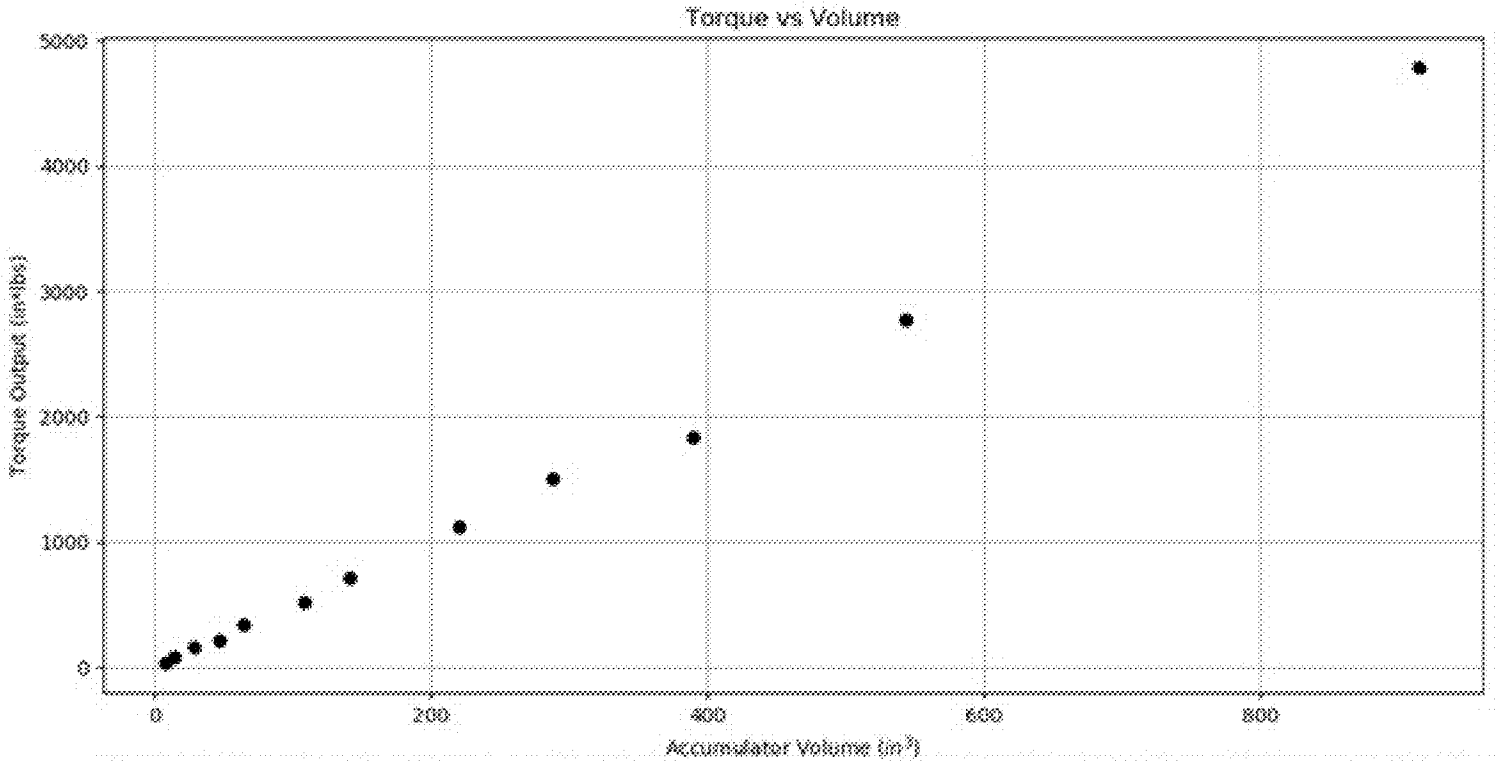
FIG. 23 is an exemplary graphical representation of torque output vs accumulator volume (accumulator size)

Referring briefly to FIG. 23, the figure graphically depicts an advantage of the embodiment of the electric power actuator utilizing an interchangeable pressure vessel. Pneumatic actuators are typically sized according the torque output necessary to operate on the valve they are coupled or otherwise operatively connected to. As the size of fluid valves and fluid pressure contained within them increase, so must the torque output of the actuator that is used to open and close the valves. As the torque output of the pneumatic actuator increases, either the pressure contained within the actuator must increase or the area of the piston that is being acted on by some pressurized fluid must be increased, due to the relationship of Force=Pressure*Area. It is common for pneumatic actuators to have their torque output increased by increasing the area of the piston that is being acted on by some pressurized fluid. This increase in area also increases the volume of fluid required to operate the actuator at some predetermined pressure. Some embodiments of the electric power actuator include an accumulator which is used to store pressurized fluid such as, for example accumulator 2 in FIG. 1 or accumulator 2 in FIG. 3.

In another alternative embodiment of the electric power actuator, these aforementioned accumulators may be interchangeable, allowing for the entire system to be resized for a valve requiring a higher torque output by simply changing only two components, the pneumatic actuator such as, for example pneumatic actuator 4 in FIG. 1 or pneumatic actuator 4 in FIG. 3. Because the embodiment of the electric power actuator operates by exchanging pressurized fluid from an accumulator to a fluid actuator, by increasing the size of the accumulator and the size of the actuator the system could, provide any possible torque output. When compared to the current state of common gear driven electric actuators, this is a major improvement. As noted above, electric actuators are typically sized for the valve that they are powering, and their torque output is unable to be changed in any meaningful and useful way. This causes several issues including the requirement for each electric actuator designed by a single manufacturer have its own variable bill of materials as well rendering the actuator unusable on any valve size other than the one it was initially purchased for. This results in the need for a facility to maintain spare parts or entire actuators for each valve size. The disclosed embodiment of the electric power actuator that utilizes an interchangeable fluid actuator and accumulator allows for the same base system to operate on valves having a wide range of torque outputs by simply swapping components such as the pneumatic actuator and/or accumulator, thereby significantly reducing the spares inventory requirement. The principle posited above is demonstrated graphically by FIG. 23, where the x-axis represents the necessary accumulator volume to produce the torque output represented by the y-axis. It should be noted that these values are derived from the torque output and corresponding air volume required specified by the Jamesbury line of VPVL pneumatic actuators.

Figure 24:
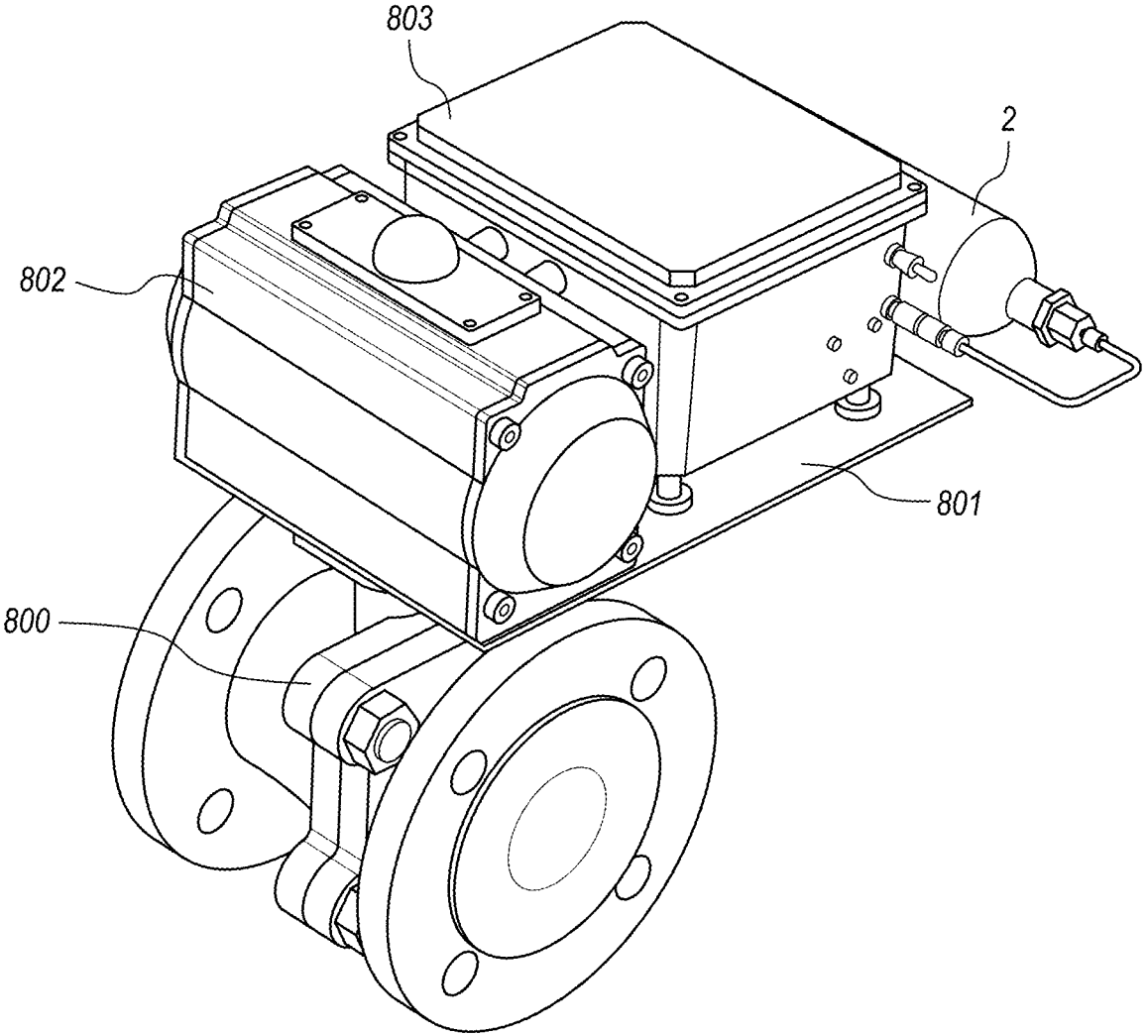
FIGS. 24-25 are perspective views of a pneumatic control system in accordance with an electric power actuator embodiment operatively associated with a valve.

As can be seen in FIG. 24 a pneumatic actuator such as, for example pneumatic actuator 802 (4 in FIG. 3) and an accumulator such as, for example accumulator 2 (as in FIG. 3) are the only external components depicted in the example final product illustration, allowing for these two components to be easily swapped out with different sized components while maintaining the integrity of the rest of the system.

Another advantage of the embodiment of the invention previously described and depicted in FIG. 24 is the way in which the system can be easily mounted on existing pneumatic actuator systems by utilization of the NAMUR (Interessengemeinschaft Automatisierungstechnik der Prozessindustrie e.V.) or similar standard interface by which pneumatic actuators and solenoid control valves are connected. This use of a standard interface allows for simple integration into operations that already utilize pre-existing pneumatic actuator systems. It should also be noted that exemplary embodiments depicted, for example, in FIGS. 25-28 utilize the ISO 5211 valve mounting standard to mount the embodiment to the valve by way of a steel or other sufficient material plate 801 which can be placed between the pneumatic actuator 802 (4 in FIG. and the valve 800 being operated on. The remaining components of the system are then made able to rest or be otherwise fastened to plate 801 in any reasonable way. It will be appreciated that a link or linkage assembly (e.g., 415, L) is mechanically connected to the stem 525 of the pneumatic actuator (e.g., 606) at a first point location and that an opposite end is suitable for connection to a valve in a manner such that movement of the stem 525 alters the open/closed position of the valve (e.g., 16, 800). Although not depicted, it is also contemplated that the disclosed embodiments may include a positioner placed fluidly connected to the outlet of the control valve 1040, to control the position of the actuator valve (e.g., a butterfly or ball type valve) between open and closed states. Such a positioner may operate on a force balance principle to position the valve in response to the pneumatic pressure applied. In this manner the disclosed embodiments are able to effectuate the pneumatic control of valves in remote locations without need to extend air/gas lines to such locations.

Figure 26:
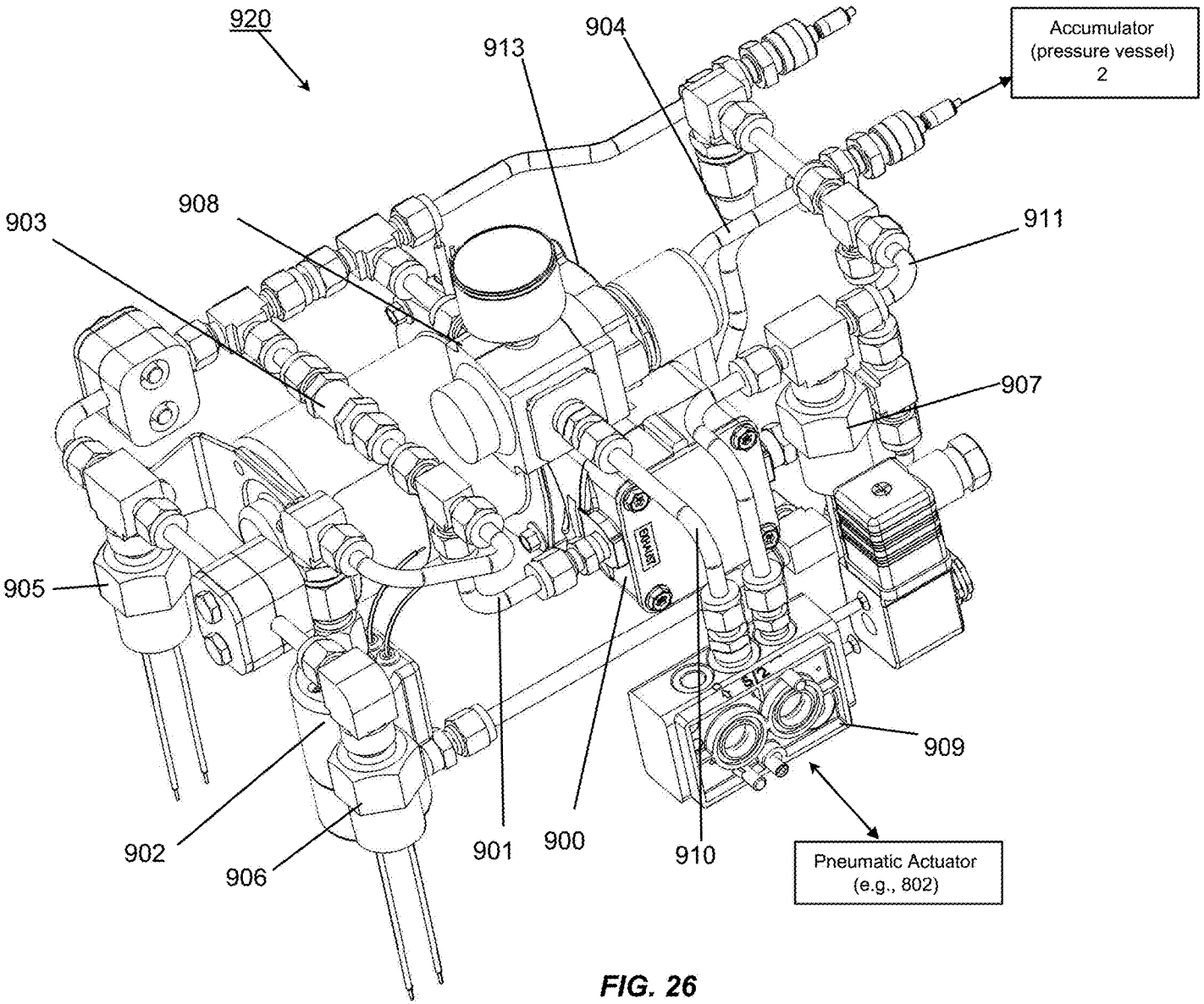
FIGS. 26-28 are exemplary perspective views of several components of an embodiment of the electric power actuator.
Figure 27:
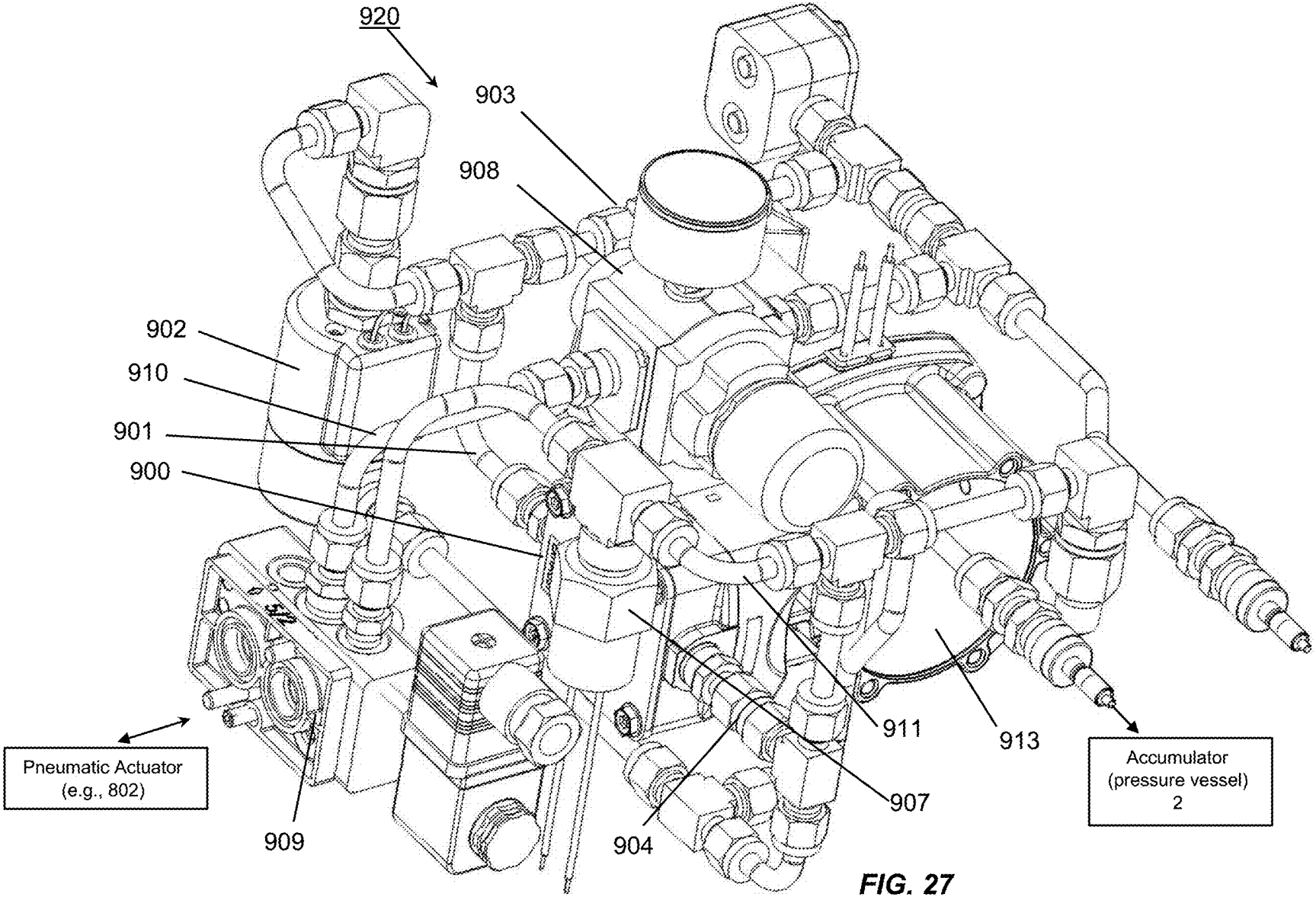
Figure 28:
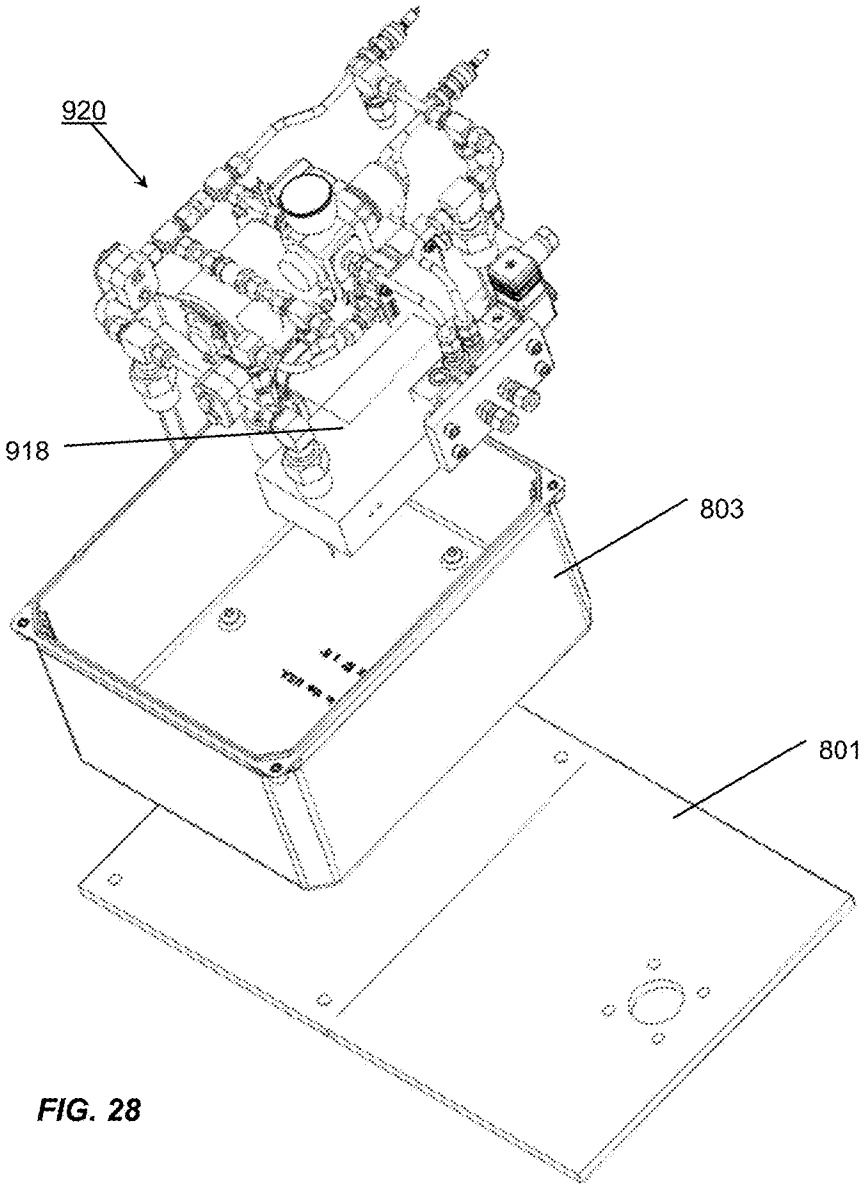

Turning next to FIGS. 26 and 27, depicted therein are example representations of electric power actuator embodiments, particularly components of pneumatic circuit 920. In the example shown, air or another gas is used as the fluid medium by which potential energy is stored in the form of compressed gas. The outlet of gas compressor 900 is connected to both control valve 902 and check valve 903 via gas line 901. The downstream end of check valve 903 is connected to pressure switch 905, pressure switch 906, pressure reducing gas regulator 908, and accumulator (pressure vessel) 2 via gas line 904. The downstream port of regulator 908 is connected to control valve 909 via gas line 910. The venting port of directional control valve 909 which is connected upstream to pressure switch 907 and the spring powered (vent) chamber of a single acting pneumatic actuator (not shown) is connected to compressor pressure equalization adapter 913 and the inlet of gas compressor 900 via gas line 911. As further represented in partial assembly FIG.

Figure 25:
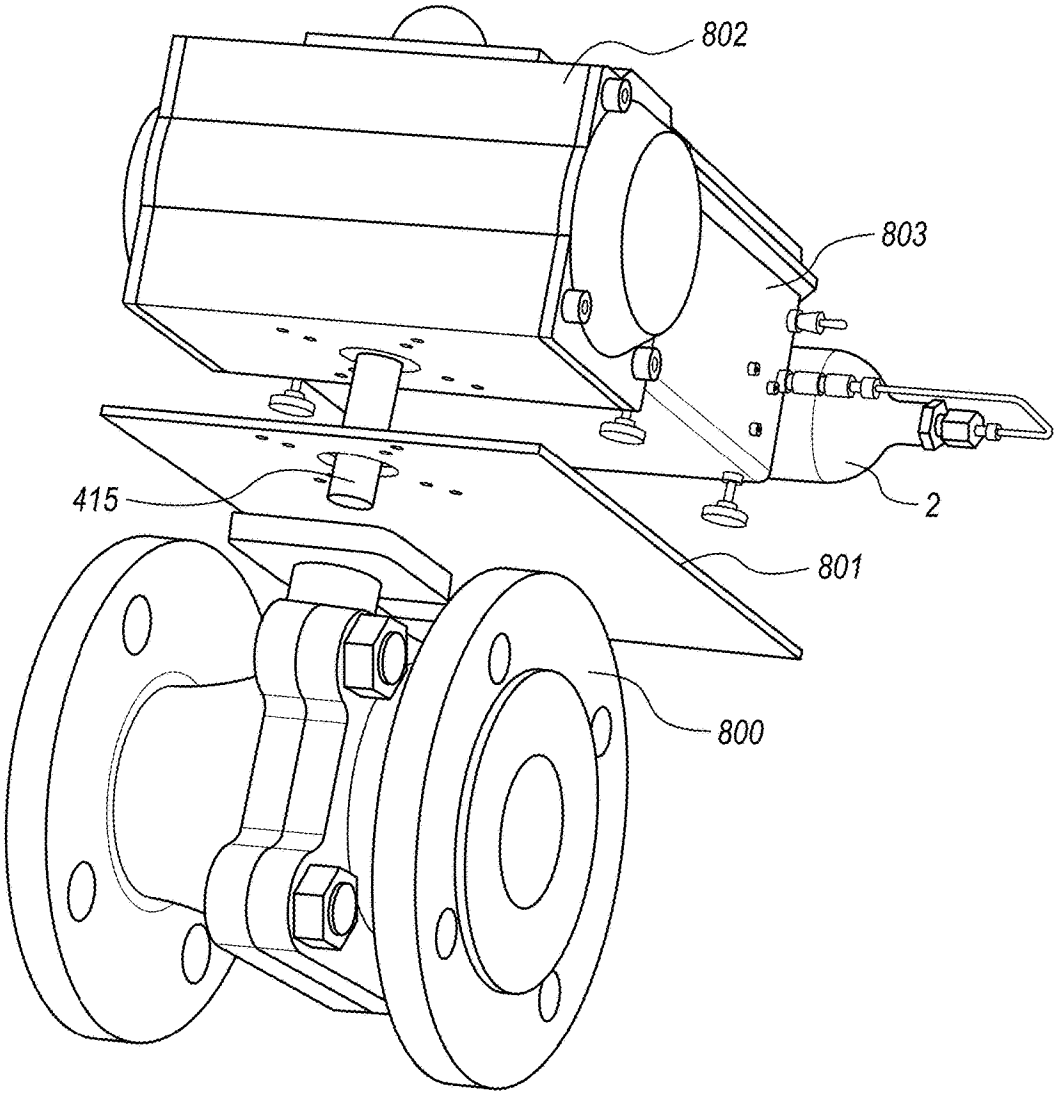

28, pneumatic circuit 920 of the electric power actuator embodiment is placed within housing 803, which is affixed to mounting plate 801 for operatively connecting the assembly to a valve such as depicted in FIGS. 24 and 25. The housing 803 may be a sealable enclosure meeting National Electrical Manufacturers Association (NEMA) and/or International Electrotechnical Commission (IEC) requirements, and thereby providing isolation of the system components. As will be appreciated, electronics interface circuitry 918 may also be included in the housing 801 and in addition to interfacing to external power and signaling. Electronics interface circuitry 918 may also include a battery or other back-up power source in order to allow the pneumatic circuit to operate in the absence of external power.

Figure 29:
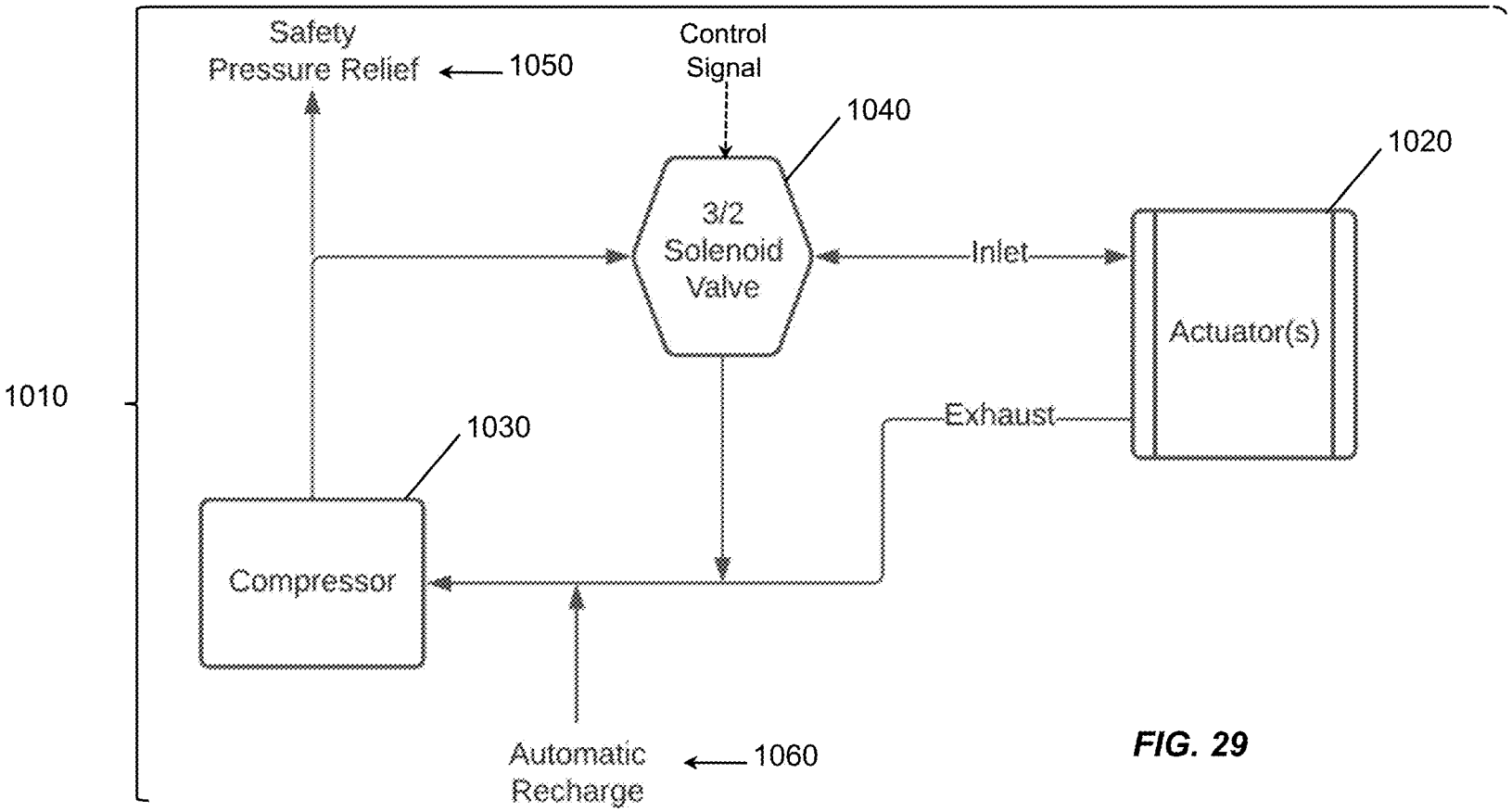
FIG. 29 is a schematic illustration of an alternative pneumatic actuator driver embodiment in a standard configuration.
Figure 30:
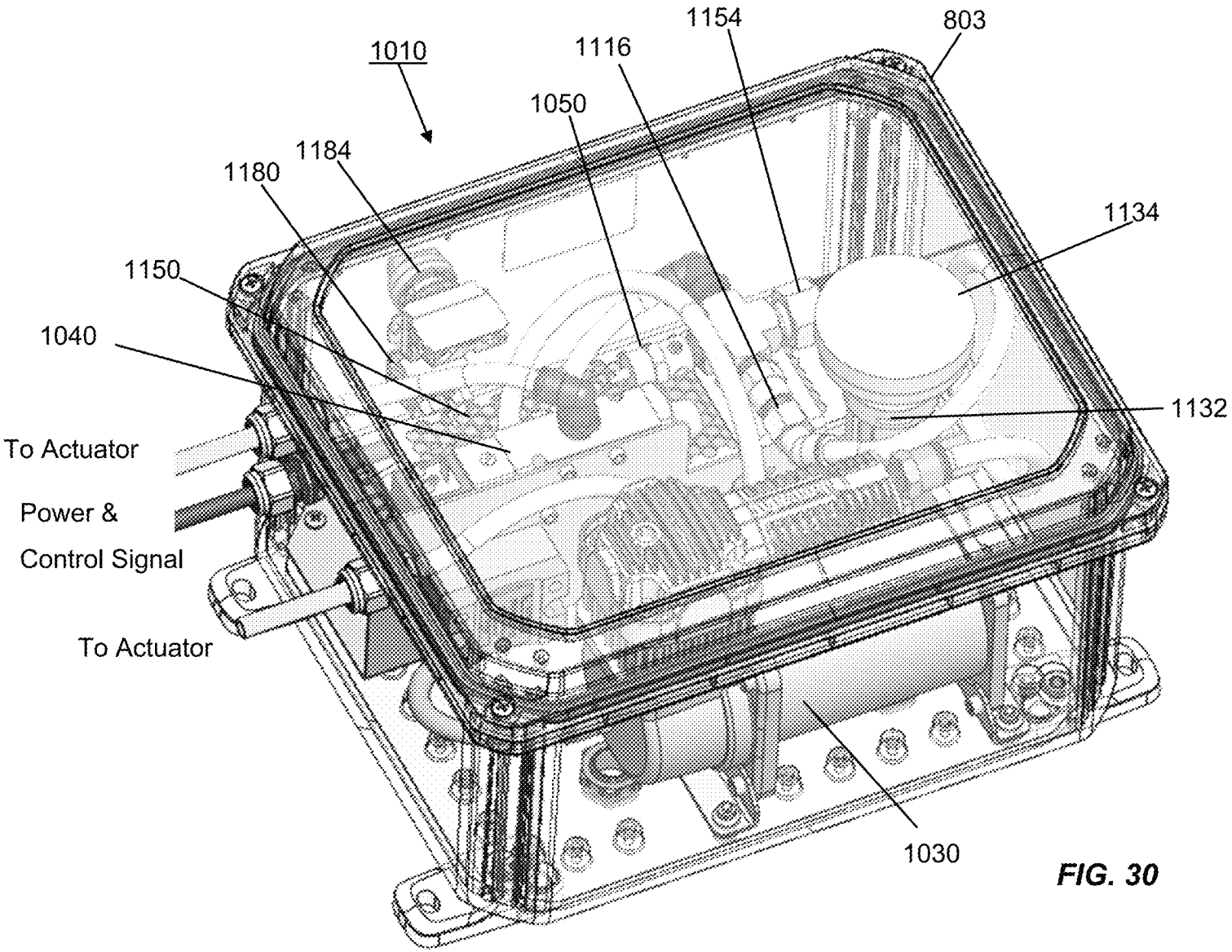
FIGS. 30-32 are perspective views of the high-speed embodiment of FIG. 29.
Figure 31:
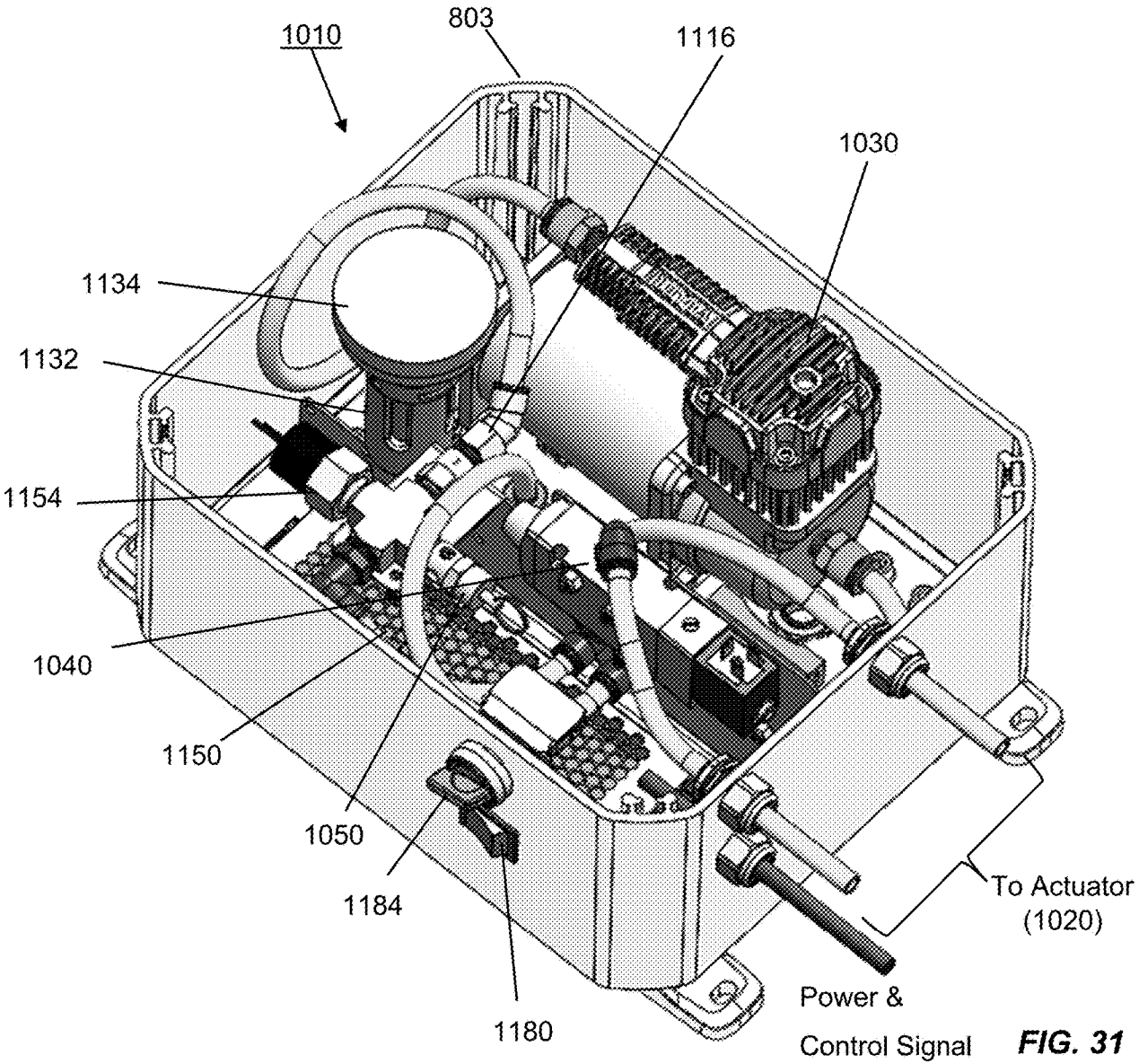
Figure 32:
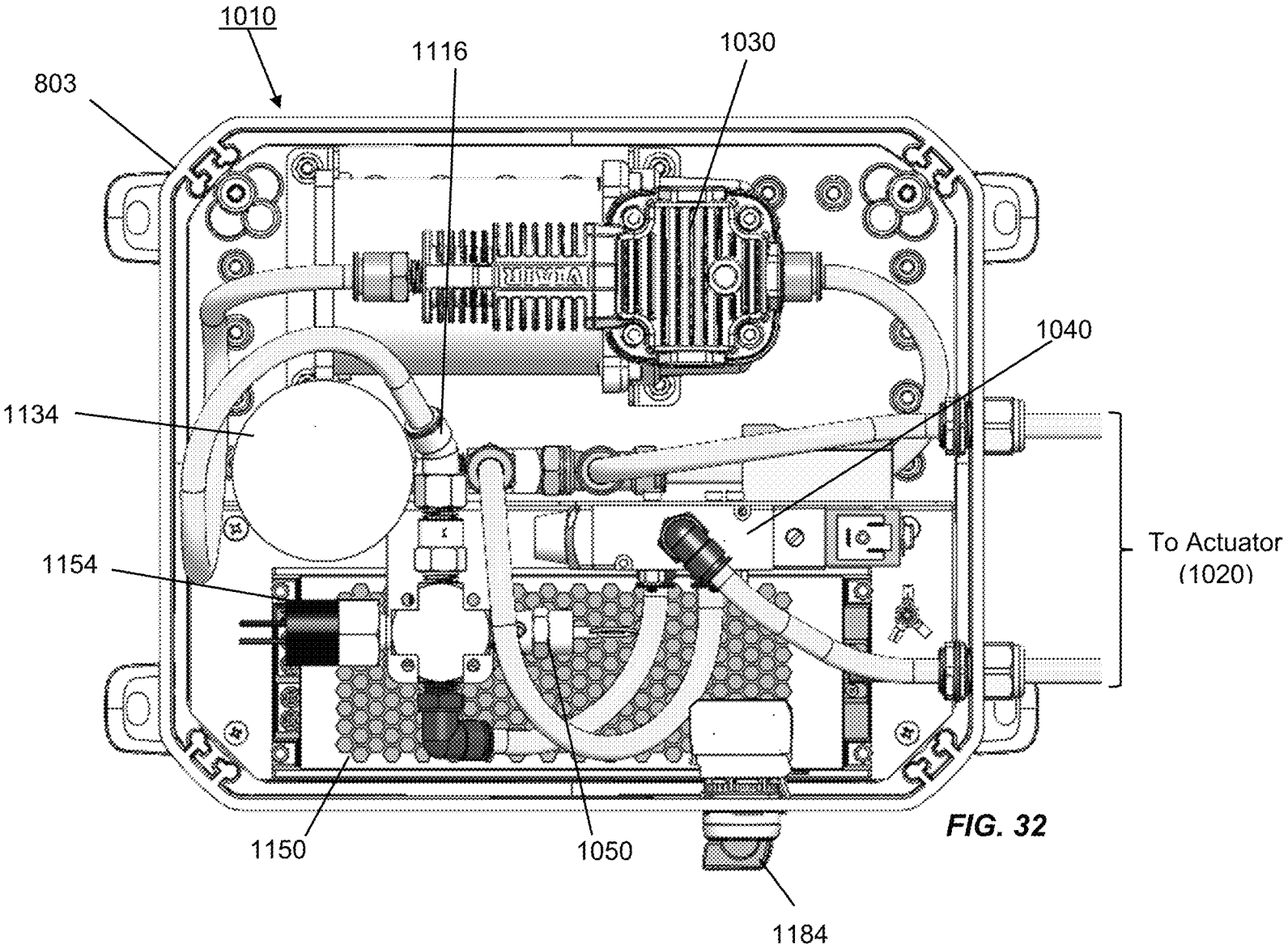

Turning next to FIGS. 29-37, depicted therein are alternative embodiments of the pneumatic actuator to electric power platform disclosed herein, providing a pneumatic compression and gas transfer system suitable for operating one or more pneumatic actuators. More specifically, FIG. 29 is a schematic illustration of an alternative actuator driver in a standard or simplified configuration which does not include a pressure tank, and FIGS. 30-32 are illustrations of an exemplary embodiment thereof. When operatively attached to a spring-return actuator, the configuration of FIGS. 29-32, is capable of providing a fail-safe, closed-loop pneumatic actuator driver 1010. Moreover, the actuator driver 1010 may be located within a housing 803 as described above, and as depicted in FIGS. 30-32, for example. As will be appreciated from the schematic and associated illustrations, the actuator driver automatically recharges and is capable to controlling one or more actuators 1020. In the unlikely event of an air leak in pneumatic actuator driver system 1010 or the actuator, the system may include a built-in recharge function 1060 to maintain pneumatic pressure.

The recharge function 1060 operates to regulate pressure to the actuator automatically via the expansion of gas. In the disclosed embodiments, this process does not use a regulator or pressure sensor, it is just due to the physics. In other words, when the air from the high-pressure tank expands into the actuator, pressure drops. This is a property of all gasses (i.e. the ideal gas law). The purpose of the pressure sensor 1154, as depicted in FIGS. 30-32 and 34-37 is to trigger the "recharge" function. When the regulated pressure after expansion to the actuator, is too low, the pressure sensor signals the compressor to turn on and draw more air in to recharge the pneumatic system. If the regulated pressure is not depleted sufficiently, pressure sensor does nothing, and the compressor 1030 stays off.

Most actuator systems require a regulator to step the pressure down from a higher-pressure source, to be within limits that the actuator 1020 can handle without damage. Self-regulation is useful because not only is the need for regulator eliminated, thereby reducing cost and maintenance, and improving reliability), but the disclosed system also provides higher air flow to the actuator than a conventional system is capable of. This means the actuator can move faster than is typically seen in conventional regulator-based systems, because the pressure at the start of stroke is higher than at the end of stroke.

In a manner similar to that described in detail above relative to the earlier embodiments, the actuator driver 1010 includes a compressor 1030, having an intake port fluidly connected to an exhaust port(s) of the actuator(s) 1020. As will be appreciated, the compressor is a source of pressurized fluid (gas) that has a low pressure side (compressor input) and a high pressure side (compressor output). The outlet of compressor 1030 is fluidly connected to the 3/2 solenoid valve 1040 as well as to a pressure relief valve 1050, which limits the system pressure The system may further include a recharge capability such as from an automatic recharge mechanism 1060, in the event that additional air (gas) volume needs to be added to the system.

Figure 33:
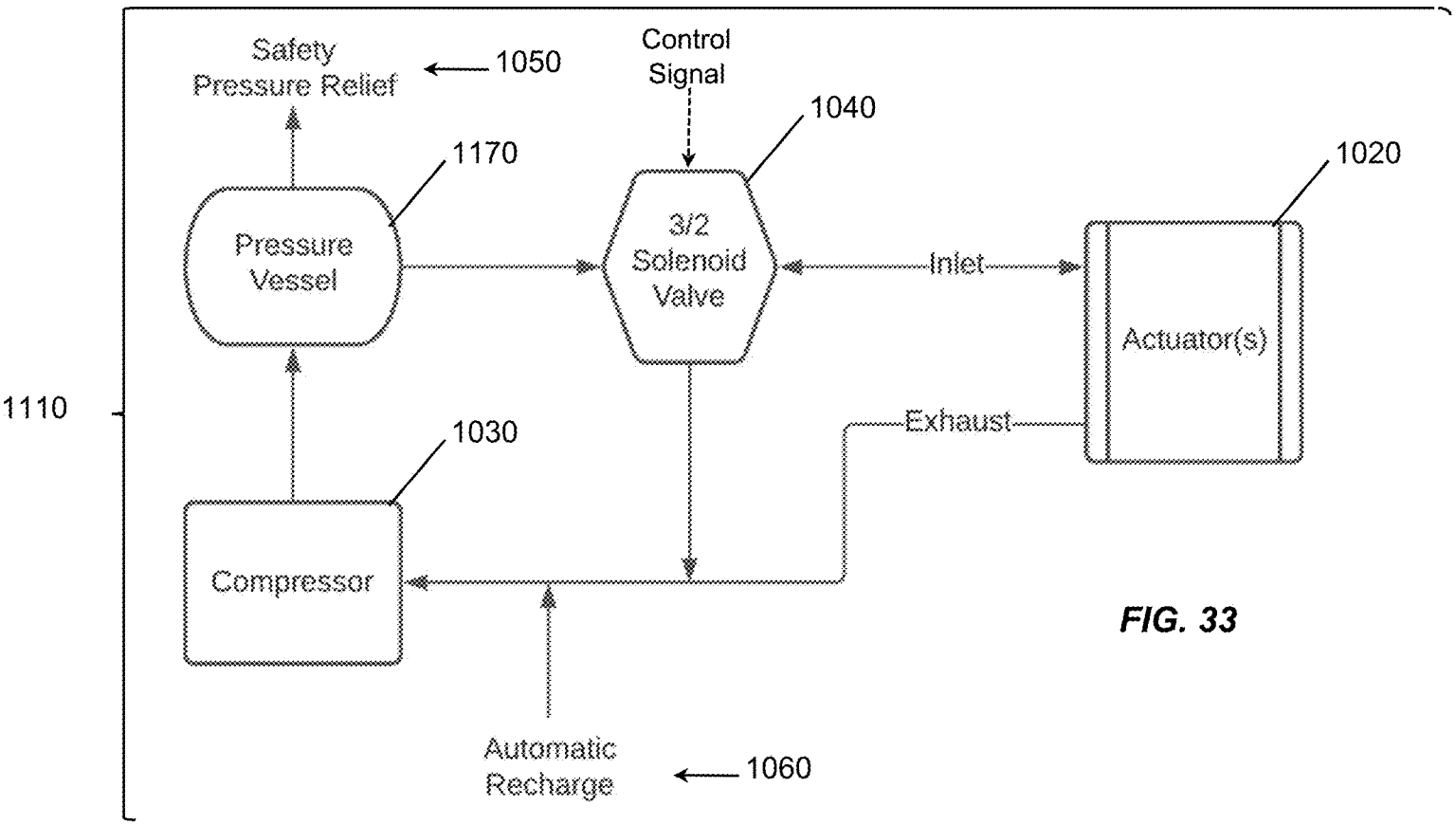
FIG. 33 is a schematic illustration of an alternative pneumatic actuator driver embodiment in a high-speed configuration.
Figure 34:
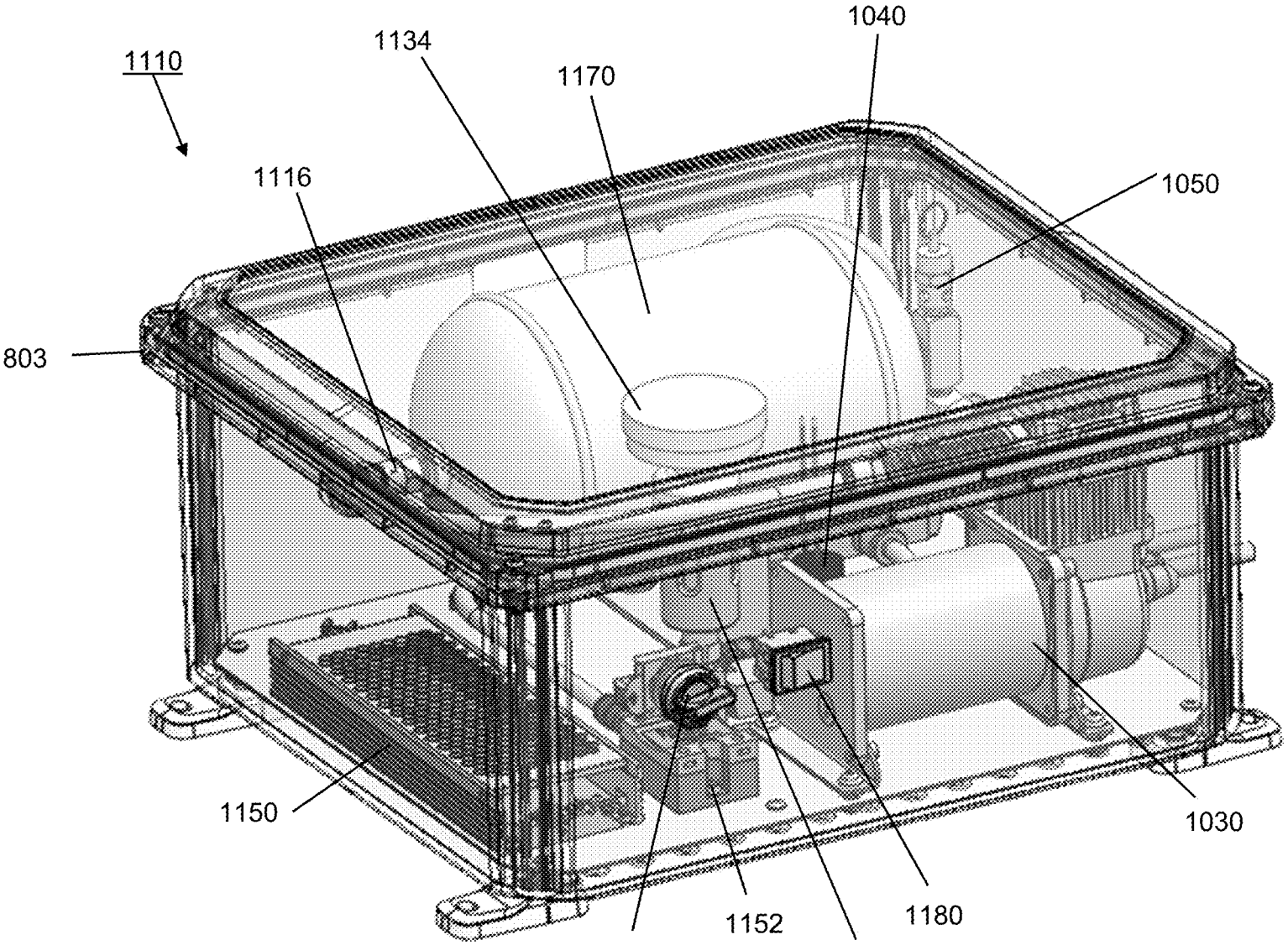
FIGS. 34-37 are exemplary illustrations of the high-speed embodiment of FIG. 33.
Figure 35:
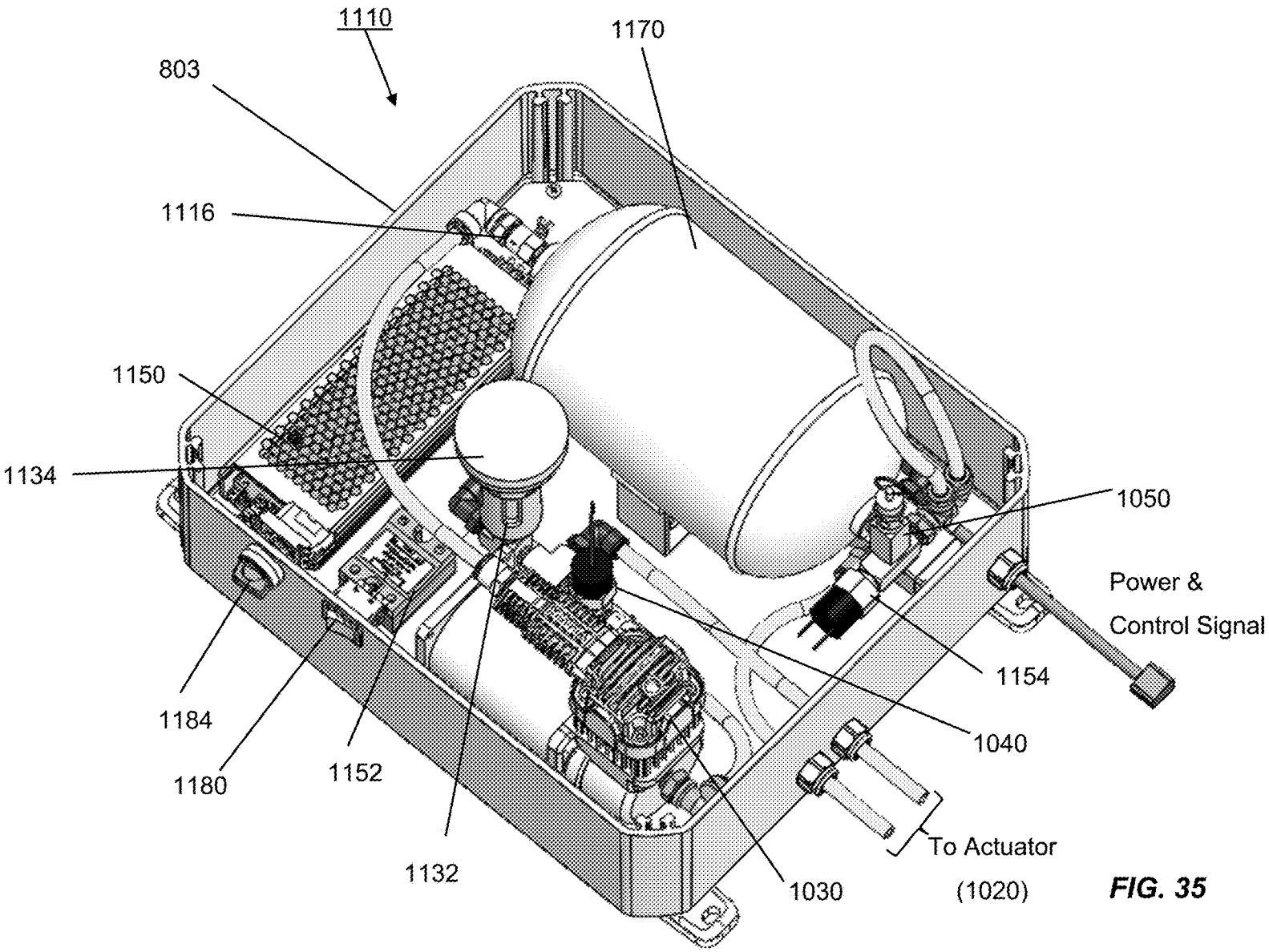
Figure 36:
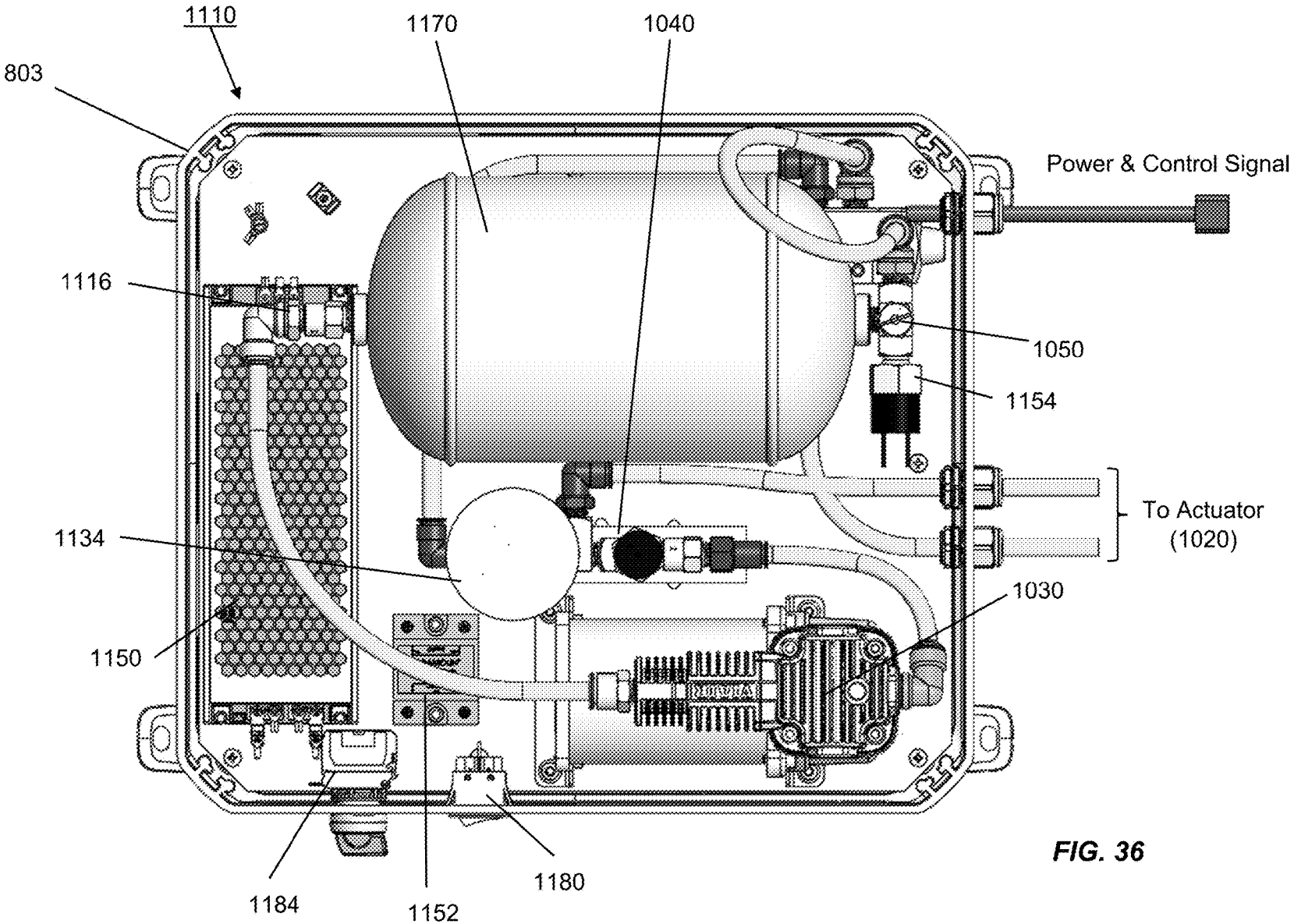
Figure 37:
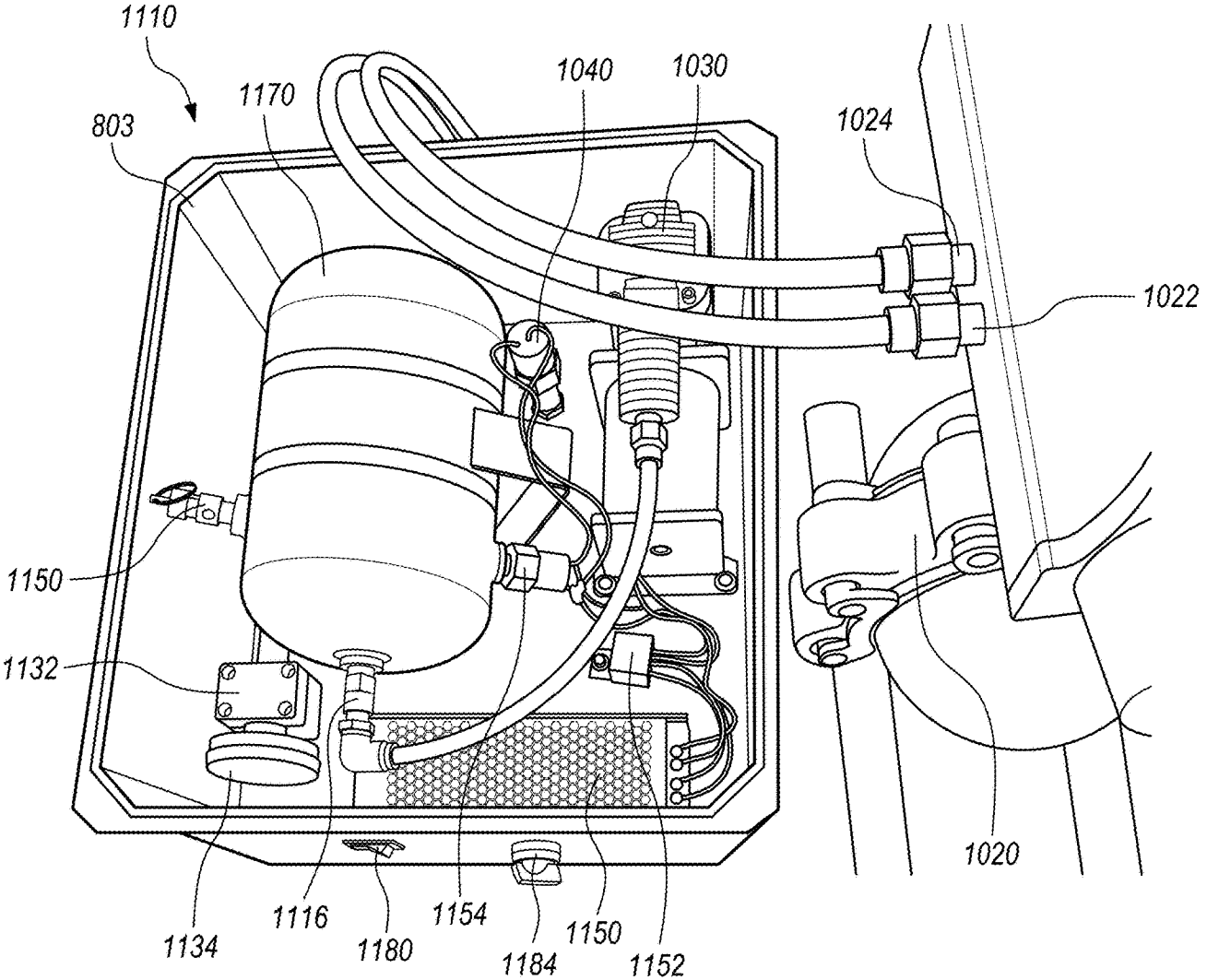

FIG. 33 is a schematic illustration of a high-speed pneumatic actuator driver embodiment 1110, whereas FIGS. 34-37 are examples of how such an embodiment may be implemented. When operatively attached to a spring-return actuator 1020, the pneumatic actuator driver 1110, is capable of providing higher-speed fail-safe, closed-loop operation through the addition of pressure vessel or tank 1170, such as a pressure tank (e.g., VIAIR P/N 91014). Moreover, the actuator driver 1110 may be located within housing 803 as depicted in FIGS. 34-37. As will be appreciated from the schematic and associated illustrations, the actuator driver automatically pre-charges and recharges and is capable to controlling one or more actuators 1020.

An advantage of the disclosed embodiments of FIGS. 29-37 is the ability of this alternative system embodiment to operate in a non-regulated pressure configuration without controlling fluid (gas) pressure available to the actuator using a regulator. In one embodiment, the system (1010 or 1110) is pre-charged with the correct amount of fluid (gas) mass. The total mass in the actuator, tank (optional), tubes, compressor and all other parts is set to a predetermined amount based upon the volume and other characteristics of the system and associated actuator(s) 1020. After pre-charging, the system (1010 or 1110) is ready for cyclic operation. In operation, the bulk of the fluid mass is forced into the tank or pressure vessel 1170 (or simply fluid volume of the tankless system 1010), which is accomplish using a compressor pressure sensor (not shown) on the inlet of the compressor. To initiate the operation the inlet pressure to the compressor is pumped down until the compressor pressure sensor is at a predetermined value of about 2.0 psi, although pressures in the range of about 0 psi to about 10 psi may also be suitable. Note that the high-pressure switch 1154 does not play a role here, but only serves to determine when system recharging is completed.

Next, when necessary to operate the actuator, to move it or change state as a fail-safe operation in response to an external signal, valve 1040 is opened to allow the tank pressure to expand and cause fluid flow to the actuator to cause the actuator 1020 to change state. The pressure self regulates down because of this expansion. At the end of this actuator state change operation, both the tank 1170 and actuator are at the same pressure. A subsequent change to the external control signal would result in valve 1040 closing, or more accurately being redirected to the input of compressor 1030, which would in turn relieve the pressure on the inlet of the actuator 1020, and thereby allow it to return to its nominal state.

The system further includes a recharge capability, represented by the automatic recharge mechanism 1060 in FIG. 33, in the event that additional air (gas) volume needs to be added to the system. The recharge feature may include a pneumatic connection to the inlet air control 1132 (e.g. solenoid with check valve) and filter 1134 as illustrated in FIGS. 34-37.

In a manner similar to that described in detail above relative to the earlier embodiments, the actuator driver 1110 includes compressor 1030, such as a 250C-IG 150 psi Compressor (e.g., VIAIR P/N 25050). In the disclosed embodiment, the VIAIR compressor is a "sealed motor" compressor that includes a minor modification to the standard compressor motor, to eliminate a possible, minor air leak through a braided, insulted wire coming off the motor. Once again, the compressor 1030 has an intake port fluidly connected to an exhaust port(s) 1022 of the actuator(s) 1020. The outlet of compressor 1030 is fluidly connected to the 3/2 solenoid valve 1040 via tank 1170 as well as to a pressure relief valve 1050 connected to the tank 1170 to limit the system pressure. As will be appreciated, one or more check valves (e.g., 1116) may be put in place to control flow of air (gas) in the system. In one embodiment, the system pressure and flow rate may be configurable and/or adjustable over ranges suitable to operate one or more actuators.

The tank 1170 serves as a source of pressurized air (gas) and is fluidly connected, through the 3/2 valve 1040, to the inlet 1024 of the actuator(s) 1020, and to the inlet of compressor 1030, thereby closing the pneumatic control loop. Further electrical controls in the illustrated embodiment of FIGS. 34-37 include a power supply 1150, which provides power, via relay 1152, to operate the compressor 1030, in response to pressure switch 1154, which may be a diaphragm-type low pressure switch set, for example, for 80 psi (falling) (e.g., Nason SM-1B-80F/xxx). Such a switch would cause the compressor to activate in order to maintain the desired pressure in the tank and the closed pneumatic system. Also depicted in the embodiment of FIGS. 34-37 is a system on/off switch 1180, as well as a test/demo switch 1184 that would simulate a control signal to the system for changing the state of the actuator(s), as well as allow the system to be tested in use.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. An electric-powered fail-safe actuator system, including:

an electrically-powered source of pressurized fluid including a pneumatic compressor;

at least one actuator;

a solenoid-actuated control valve fluidly connected between the source of pressurized fluid and an inlet port on the at least one actuator, the control valve controlling the flow of pressurized fluid from the source to the actuator in response to a control signal, wherein a pressurized fluid applied to the inlet port causes movement of the actuator; and an enclosure, said enclosure housing at least the source of pressurized fluid, the control valve and fluid line therein.

2. The electric-powered fail-safe actuator system according to claim 1 further including a pressure vessel, fluidly connected as the source of pressurized fluid.

3. The electric-powered fail-safe actuator system according to claim 2 further including at least one regulator fluidly connected and interposed in series between the source of pressurized fluid and the control valve, said regulator controlling the supply of fluid into the directional control valve.

4. The electric-powered fail-safe actuator system according to claim 1 wherein an outlet port of said actuator is fluidly connected to an inlet of said electrically-powered source of pressurized fluid to form a closed loop circuit including said electrically-powered source of pressurized fluid, said at least one actuator and said solenoid-actuated control valve and where said closed loop circuit is isolated from ambient gases.

5. The electric-powered fail-safe actuator system according to claim 1 wherein said actuator is single-acting.

6. The electric-powered fail-safe actuator system according to claim 1 wherein the pressurized fluid applied to the inlet port causes movement of a biased piston in said actuator and produces movement of a stem attached to the piston;

wherein an inlet of the compressor is fluidly connected to a vent port of the actuator; and wherein the fail-safe actuator is suitable for mechanical connection between the stem and a valve.

7. The electric-powered fail-safe actuator system according to claim 6 further including an outlet of the compressor fluidly connected to the source of pressurized fluid.

8. The electric-powered fail-safe actuator system according to claim 1 further including at least one pressure sensor fluidly connected to the source of pressurized fluid, said pressure sensor controlling the source of pressurized fluid, and thereby the pressure available to the directional control valve.

9. The electric-powered fail-safe actuator system according to claim 1 wherein said actuator is a pneumatic actuator selected from the group consisting of: a single-acting type, a double-acting type, a vane type, a diaphragm type, a scotch yoke type and a linear type.

10. An electric-powered fail-safe system for connection to at least one pneumatic actuator, including:

an electrically-powered source of pressurized fluid including a pneumatic compressor;

a solenoid-actuated control valve fluidly connected between the source of pressurized fluid and an inlet port on the at least one actuator, the control valve controlling flow of pressurized fluid from the source of pressurized fluid to the actuator in response to a control signal, wherein pressurized fluid applied to an inlet port of the actuator to cause a change in the position of the actuator; and an enclosure, said enclosure housing at least the source of pressurized fluid and the control valve therein.

11. The electric-powered fail-safe system according to claim 10 further including a pressure vessel, fluidly connected as the source of pressurized fluid.

12. The electric-powered fail-safe system according to claim 11 further including an outlet of the compressor fluidly connected to the source of pressurized fluid.

13. The electric-powered fail-safe system according to claim 10 further including at least one pressure sensor fluidly connected to the source of pressurized fluid, said pressure sensor controlling the source of pressurized fluid, and thereby the pressure available to the control valve.

14. The electric-powered fail-safe system according to claim 10 wherein said actuator is a pneumatic actuator selected from the group consisting of: a single-acting type, a double-acting type, a vane type, a diaphragm type, a scotch yoke type and a linear type.

15. A method for providing an electric-powered fail-safe system for at least one pneumatic actuator, comprising:

providing an electrically-powered source of pressurized fluid;

fluidly connecting a directional control valve, responsive to a control signal, in series between the source of pressurized fluid and the at least one pneumatic actuator;

fluidly connecting a vent port of the at least one pneumatic actuator to an input to the source of pressurized fluid to isolate the pneumatic circuit from ambient gases;

using the directional control valve to control the flow of pressurized fluid to the at least one pneumatic actuator;

triggering, in response to a control signal, a first state transition of the directional control valve to allow pressurized fluid to flow to the at least one pneumatic actuator, thereby producing a change in state of the at least one pneumatic actuator; and triggering, in response to a change in the control signal, a second state transition of the directional control valve thereby producing a change in state of the at least one pneumatic actuator.

16. The method according to claim 15, wherein the source of pressurized fluid provides the pressurized fluid at a predetermined pressure controlled by a pressure switch fluidly connected thereto.

17. The method according to claim 15 further comprising fluidly connecting at least one check valve between the source of pressurized fluid and the at least one pneumatic actuator.

18. A pneumatic compression and gas transfer system for connection to at least one pneumatic actuator, including:

a source of pressurized fluid having a low pressure side and a high pressure side;

at least one flow control valve fluidly connected to the high pressure side of the source of pressurized fluid, a pressure port of the at least one pneumatic actuator, and the low pressure inlet of the source of pressurized fluid; and an exhaust port of the at least one pneumatic actuator fluidly connected to the at least one flow control valve, thereby establishing a nominally closed loop fluid cycle between the pneumatic compression and gas transfer system and the at least one pneumatic actuator.

19. The pneumatic compression and gas transfer system of claim 18, further including a charging device connected to the low pressure side of the source of pressurized fluid permitting introduction of gas into the closed loop fluid cycle, including:

at least one filter; and at least one check-valve, fluidly connected between the filter and the low pressure side of the source of pressurized fluid, said at least one check valve allowing gas flow only into the closed loop system.

20. The pneumatic compression and gas transfer system of claim 18 wherein said at least one pneumatic actuator is selected from the group of actuators consisting of: a single-acting type, a double-acting type, a vane type, a diaphragm type, a scotch yoke type and a linear type.

21. A method for controlling gas pressure applied to a pneumatic actuator, comprising:

providing a non-regulated source of pressurized fluid, said source being fluidly connected to an input of a control valve, wherein the fluid pressure is unregulated;

fluidly connecting a vent port of the pneumatic actuator to an input of the non-regulated source of pressurized fluid to isolate a pneumatic circuit including at least the non-regulated source of pressurized fluid, the control valve and the pneumatic actuator;

changing the position of the control valve from a first state to a second state to cause fluid flow into the pneumatic actuator, wherein high pressure fluid is released from the source of pressurized fluid and allowed to expand into the inlet of the actuator, thereby causing the actuator to change state; and changing the position of the control valve from the second state to the first state to stop fluid flow into the pneumatic actuator, and thereby allowing the actuator to return to its nominal state.

* * * * *